US011393400B2

(12) United States Patent
Cao et al.

(10) Patent No.: US 11,393,400 B2
(45) Date of Patent: Jul. 19, 2022

(54) PIXEL DRIVING CIRCUIT INCLUDING A COMPENSATION SUB-CIRCUIT AND DRIVING METHOD THEREOF, DISPLAY DEVICE

(71) Applicants: MIANYANG BOE OPTOELECTRONICS TECHNOLOGY CO.,LTD., Sichuan (CN); BOE TECHNOLOGY GROUP CO., LTD., Beijing (CN)

(72) Inventors: Xin Cao, Beijing (CN); Yawei Zhu, Beijing (CN); Heungsik Kim, Beijing (CN); Jing Hu, Beijing (CN); Zifeng Wang, Beijing (CN); Haifeng Xu, Beijing (CN); Haoyuan Fan, Beijing (CN)

(73) Assignees: MIANYANG BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/376,506

(22) Filed: Jul. 15, 2021

(65) Prior Publication Data

US 2022/0020330 A1 Jan. 20, 2022

(30) Foreign Application Priority Data

Jul. 16, 2020 (CN) ..... 202010686292.4

(51) Int. Cl.

| | |
|---|---|
| ***G09G 3/3258*** | (2016.01) |
| ***G09G 3/3266*** | (2016.01) |
| ***G09G 3/3275*** | (2016.01) |

(52) U.S. Cl.

CPC ..... *G09G 3/3258* (2013.01); *G09G 3/3266* (2013.01); *G09G 3/3275* (2013.01); *G09G 2310/0278* (2013.01)

(58) Field of Classification Search

None

See application file for complete search history.

(56) References Cited

U.S. PATENT DOCUMENTS

2016/0321997 A1* 11/2016 Jeong ..... H01L 29/78696
2021/0056895 A1* 2/2021 Lee ..... G09G 3/3233

FOREIGN PATENT DOCUMENTS

CN 204680360 U * 9/2015
CN 106935198 A * 7/2017 ..... G09G 3/3225

* cited by examiner

*Primary Examiner* — Kirk W Hermann
(74) *Attorney, Agent, or Firm* — Dority & Manning, P.A.

(57) ABSTRACT

A pixel driving circuit includes a reset sub-circuit configured to be turned on in response to a control signal, and transmit a reference voltage to a first node to reset a voltage of the first node; an input sub-circuit configured to transmit a data signal to a second node in response to a gate scan signal; a driving sub-circuit configured to be turned on or off in response to a voltage of the first node, write the data signal and a compensation signal into a third node, and output a driving signal according to the voltage of the first node; a compensation sub-circuit configured to transmit the data signal and the compensation signal to a fourth node in response to the gate scan signal; and a voltage control sub-circuit configured to control the voltage of the first node according to a voltage of the fourth node.

20 Claims, 13 Drawing Sheets

PIXEL DRIVING CIRCUIT INCLUDING A COMPENSATION SUB-CIRCUIT AND DRIVING METHOD THEREOF, DISPLAY DEVICE

CROSS-REFERENCE TO RELATED APPLICATION

This application claims priority to Chinese Patent Application No. 202010686292.4, filed on Jul. 16, 2020, which is incorporated herein by reference in its entirety.

TECHNICAL FIELD

The present disclosure relates to the field of display technologies, and in particular, to a pixel driving circuit and a driving method thereof, and a display device.

BACKGROUND

Self-luminous display devices, such as organic light-emitting diode (OLED) display devices are widely used in various kinds of display products due to their self-luminescence, wide viewing angle, high contrast, fast response speed, low power consumption, and ultra-thin and ultra-light design.

SUMMARY

In one aspect, a pixel driving circuit is provided. The pixel driving circuit includes a reset sub-circuit, an input sub-circuit, a driving sub-circuit, a compensation sub-circuit and a voltage control sub-circuit. The reset sub-circuit is coupled to a control signal terminal, a reference signal terminal and a first node. The input sub-circuit is coupled to a gate scan signal terminal, a data signal terminal and a second node. The driving sub-circuit is coupled to the first node, the second node and a third node. The compensation sub-circuit is coupled to the gate scan signal terminal, the third node and a fourth node. The voltage control sub-circuit coupled to the first node and the fourth node. The reset sub-circuit is configured to be turned on in response to a control signal received at the control signal terminal, and transmit a reference voltage received at the reference signal terminal to the first node to reset a voltage of the first node. The input sub-circuit is configured to transmit a data signal received at the data signal terminal to the second node in response to a gate scan signal received at the gate scan signal terminal. The driving sub-circuit is configured to be turned on or off in response to a voltage of the first node; and to write the data signal and a compensation signal into the third node. The compensation sub-circuit is configured to transmit the data signal and the compensation signal to the fourth node in response to the gate scan signal. The voltage control sub-circuit is configured to control the voltage of the first node according to a voltage of the fourth node, and the driving sub-circuit is further configured to output a driving signal according to the voltage of the first node.

In some embodiments, the reset sub-circuit includes a first transistor. A control electrode of the first transistor is coupled to the control signal terminal, a first electrode of the first transistor is coupled to the reference signal terminal, and a second electrode of the first transistor is coupled to the first node.

In some embodiments, the first transistor is an oxide thin film transistor.

In some embodiments, the compensation sub-circuit includes a second transistor, a control electrode of the second transistor being coupled to the gate scan signal terminal, a first electrode of the second transistor being coupled to the third node, a second electrode of the second transistor being coupled to the fourth node; and/or, the voltage control sub-circuit includes a storage capacitor, a first terminal of the storage capacitor being coupled to the fourth node, a second terminal of the storage capacitor being coupled to the first node.

In some embodiments, the input sub-circuit includes a third transistor. A control electrode of the third transistor is coupled to the gate scan signal terminal, a first electrode of the third transistor is coupled to the data signal terminal, and a second electrode of the third transistor is coupled to the second node.

In some embodiments, the driving sub-circuit includes a driving transistor. A control electrode of the driving transistor is coupled to the first node, a first electrode of the driving transistor is coupled to the second node, and a second electrode of the driving transistor is coupled to the third node.

In some embodiments, the pixel driving circuit further includes a first light-emitting control sub-circuit. The first light-emitting control sub-circuit is coupled to a light-emitting control signal terminal, a first voltage terminal and the second node. The first light-emitting control sub-circuit is configured to transmit a first voltage of the first voltage terminal to the driving sub-circuit in response to a light-emitting control signal received at the light-emitting control signal terminal.

In some embodiments, the first light-emitting control sub-circuit includes a fourth transistor. A control electrode of the fourth transistor is coupled to the light-emitting control signal terminal, a first electrode of the fourth transistor is coupled to the first voltage terminal, and a second electrode of the fourth transistor is coupled to the second node.

In some embodiments, the pixel driving circuit further includes a second light-emitting control sub-circuit. The second light-emitting control sub-circuit is coupled to the light-emitting control signal terminal and the third node. The second light-emitting control sub-circuit is configured to be further coupled to a light-emitting device. The second light-emitting control sub-circuit is further configured to make the driving sub-circuit and the light-emitting device form a conductive path, in response to the light-emitting control signal received at the light-emitting control signal terminal, so that the driving signal is transmitted to the light-emitting device.

In some embodiments, the second light-emitting control sub-circuit includes a fifth transistor. A control electrode of the fifth transistor is coupled to the light-emitting control signal terminal, a first electrode of the fifth transistor is coupled to the third node, and a second electrode of the fifth transistor is configured to be coupled to the light-emitting device.

In some embodiments, the pixel driving circuit further includes an initialization sub-circuit. The initialization sub-circuit is coupled to a first reset signal terminal, a second reset signal terminal, an initialization signal terminal, and the fourth node. The initialization sub-circuit is configured to be further coupled to the light-emitting device. The initialization sub-circuit is further configured to: transmit an initialization signal received at the initialization signal terminal to the fourth node in response to a first reset signal received at the first reset signal terminal, and transmit the initialization signal to the light-emitting device in response to a second reset signal received at the second reset signal terminal.

In some embodiments, the initialization sub-circuit includes a sixth transistor and a seventh transistor. A control electrode of the sixth transistor is coupled to the first reset signal terminal, a first electrode of the sixth transistor is coupled to the initialization signal terminal, and a second electrode of the sixth transistor is coupled the fourth node. A control electrode of the seventh transistor is coupled to the second reset signal terminal, a first electrode of the seventh transistor is coupled to the initialization signal terminal, and a second electrode of the seventh transistor is configured to be coupled to the light-emitting device.

In some embodiments, the pixel driving circuit further includes an initialization sub-circuit coupled to a first reset signal terminal, a second reset signal terminal, an initialization signal terminal, the third node and the fourth node, and the third node is further electrically connected to a light-emitting device. The initialization sub-circuit is configured to: transmit an initialization signal received at the initialization signal terminal to the fourth node in response to a first reset signal received at the first reset signal terminal, and transmit the initialization signal to the light-emitting device in response to a second reset signal received at the second reset signal terminal.

In some embodiments, the initialization sub-circuit includes a sixth transistor and a seventh transistor. A control electrode of the sixth transistor is coupled to the first reset signal terminal, a first electrode of the sixth transistor is coupled to the initialization signal terminal, and a second electrode of the sixth transistor is coupled the fourth node. A control electrode of the seventh transistor is coupled to the second reset signal terminal, a first electrode of the seventh transistor is coupled to the initialization signal terminal, and a second electrode of the seventh transistor is coupled to the third node.

In some embodiments, the pixel driving circuit further includes: a first light-emitting control sub-circuit, a second light-emitting control sub-circuit, and an initialization sub-circuit. The reset sub-circuit includes a first transistor; the input sub-circuit includes a third transistor; the driving sub-circuit includes a driving transistor; the compensation sub-circuit includes a second transistor; the voltage control sub-circuit includes a storage capacitor; the first light-emitting control sub-circuit includes a fourth transistor; the second light-emitting control sub-circuit includes a fifth transistor; and the initialization sub-circuit includes a sixth transistor and a seventh transistor. A control electrode of the driving transistor is coupled to the first node, a first electrode of the driving transistor is coupled to the second node, and a second electrode of the driving transistor is coupled to the third node. A control electrode of the first transistor is coupled to the control signal terminal, a first electrode of the first transistor is coupled to the reference signal terminal, and a second electrode of the first transistor is coupled to the first node. A control electrode of the third transistor is coupled to the gate scan signal terminal, a first electrode of the third transistor is coupled to the data signal terminal, and a second electrode of the third transistor is coupled to the second node. A control electrode of the second transistor is coupled to the gate scan signal terminal, a first electrode of the second transistor is coupled to the third node, and a second electrode of the second transistor is coupled to the fourth node. A first terminal of the storage capacitor is coupled to the fourth node, and a second terminal of the storage capacitor is coupled to the first node. A control electrode of the fourth transistor is coupled to a light-emitting control signal terminal configured to provide a light-emitting control signal, a first electrode of the fourth transistor is coupled to a first voltage terminal configured to provide a first voltage, and the second electrode of the fourth transistor is coupled to the second node. A control electrode of the fifth transistor is coupled to the light-emitting control signal terminal, a first electrode of the fifth transistor is coupled to the third node, and a second electrode of the fifth transistor is configured to be coupled to a light-emitting device. A control electrode of the sixth transistor is coupled to a first reset signal terminal configured to provide a first reset signal, a first electrode of the sixth transistor is coupled to an initialization signal terminal configured to provide an initialization signal, and a second electrode of the sixth transistor is coupled to the fourth node. A control electrode of the seventh transistor is coupled to a second reset signal terminal configured to provide a second reset signal, a first electrode of the seventh transistor is coupled to the initialization signal terminal, and a second electrode of the seventh transistor is configured to be coupled to the light-emitting device.

In some embodiments, an on-off type of the first transistor is opposite to an on-off type of the second transistor, the third transistor, the fourth transistor, the fifth transistor, the sixth transistor, the seventh transistor, and the driving transistor.

In another aspect, a display device is provided. The display device includes a plurality of pixel driving circuits as described in any one of the above embodiments, and a plurality of light-emitting devices. The pixel driving circuit is coupled to a light-emitting device of the plurality of light-emitting devices, and the light-emitting device is further coupled to a second voltage terminal configured to provide a second voltage.

In yet another aspect, a driving method of the pixel driving circuit as described in any of the above embodiments is provided. The driving method includes: transmitting, by the reset sub-circuit, the reference voltage received at the reference signal terminal to the first node, in response to the control signal received at the control signal terminal; transmitting, by the input sub-circuit, the data signal received at the data signal terminal to the second node, in response to the gate scan signal received at the gate scan signal terminal; writing, by the driving sub-circuit, the data signal and the compensation signal into the third node; transmitting, by the compensation sub-circuit, the data signal and the compensation signal to the fourth node, in response to the gate scan signal; controlling, by the voltage control sub-circuit, the voltage of the first node according to the voltage of the fourth node; and outputting, by the driving sub-circuit, the driving signal according to the voltage of the first node.

In some embodiments, the pixel driving circuit further includes: an initialization sub-circuit, a first light-emitting control sub-circuit, and a second light-emitting control sub-circuit. The first light-emitting control sub-circuit is coupled to a light-emitting control signal terminal, a first voltage terminal and the second node; the second light-emitting control sub-circuit is coupled to the light-emitting control signal terminal and the third node, and is configured to be coupled to a light-emitting device; the initialization sub-circuit is coupled to a first reset signal terminal, a second reset signal terminal, an initialization signal terminal and the fourth node, and is configured to be coupled to the light-emitting device. The driving method further includes: transmitting, by the initialization sub-circuit, an initialization signal received at the initialization signal terminal to the fourth node, in response to a first reset signal received at the first reset signal terminal; transmitting, by the initialization sub-circuit, the initialization signal to the light-emitting device, in response to a second reset signal received at the second reset signal terminal; transmitting, by the first light-emitting control sub-circuit, a first voltage of the first voltage terminal to the driving sub-circuit, in response to a light-emitting control signal received at the light-emitting control signal terminal; and transmitting, by the second light-emitting control sub-circuit, the driving signal output by the driving sub-circuit according to the voltage of the first node and the first voltage to the light-emitting device, in response to the light-emitting control signal received at the light-emitting control signal terminal.

In some embodiments, the driving sub-circuit includes a driving transistor. An absolute value of a difference between the reference voltage and the first voltage is greater than an absolute value of a threshold voltage of the driving transistor.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on actual dimensions of products, actual processes of methods and actual timings of signals involved in the embodiments of the present disclosure.

DETAILED DESCRIPTION

Figure 1:
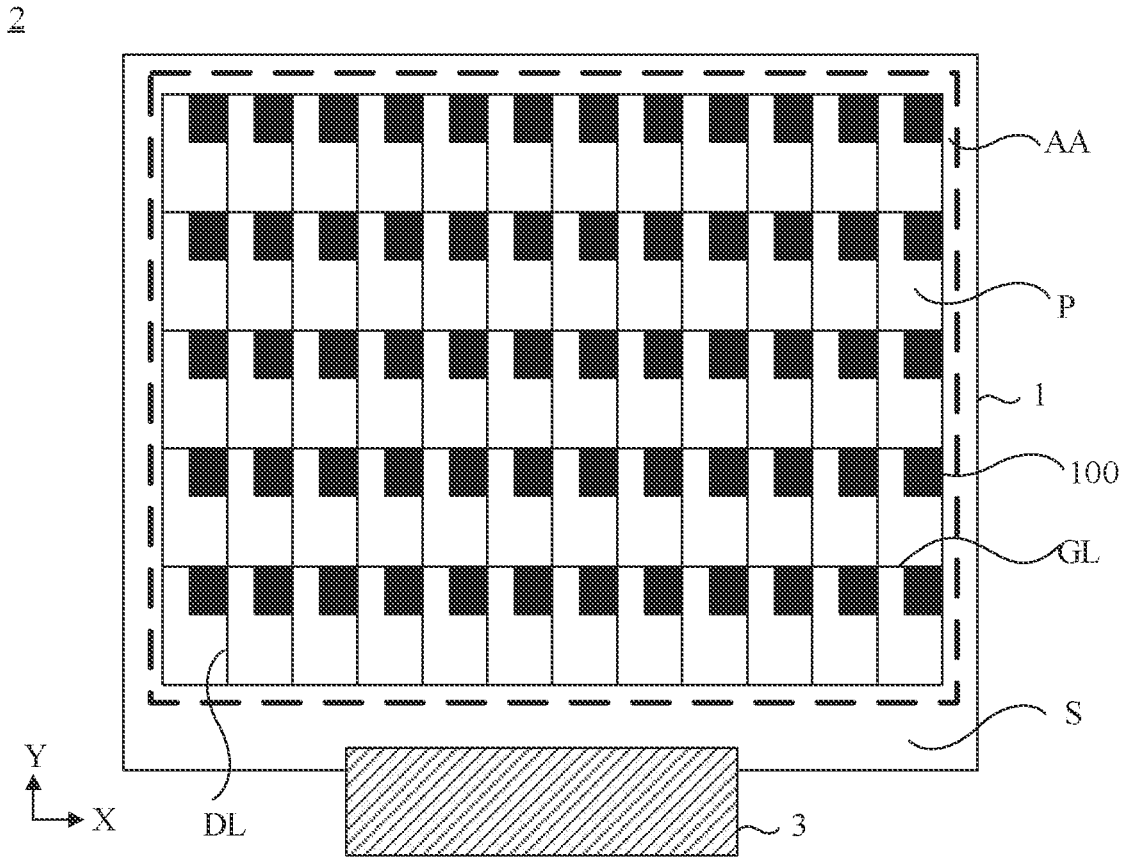
FIG. 1 is a structural diagram of a display device, in accordance with some embodiments.

Technical solutions in some embodiments of the present disclosure will be described dearly and completely with reference to the accompanying drawings below. However, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as open and inclusive, i.e., "including, but not limited to." In the description, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, features defined with "first" or "second" may explicitly or implicitly include one or more of the features. In the description of the embodiments of the present disclosure, the term "a/the plurality of" means two or more unless otherwise specified.

In the description of some embodiments, the terms "coupled", "connected" and derivatives thereof may be used. For example, the term "connected" or "electrically connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" may also mean that two or more components are not in direct contact with each other, but still cooperate or interact with each other. The embodiments disclosed herein are not necessarily limited to the content herein.

"A and/or B" includes the following three combinations: only A, only B, and a combination of A and B.

The use of "applicable to" or "configured to" indicates an open and inclusive meaning, which does not exclude apparatuses that are applicable to or configured to perform additional tasks or steps.

Exemplary embodiments are described herein with reference to sectional views and/or plan views as idealized exemplary drawings. In the accompanying drawings, thicknesses of layers and sizes of regions are enlarged for clarity. Variations in shape with respect to the accompanying drawings due to, for example, manufacturing technologies and/or tolerances may be envisaged. Therefore, the exemplary embodiments should not be construed to be limited to the shapes of regions shown herein, but to include deviations in the shapes due to, for example, manufacturing. For example, an etched region shown to be in a rectangular shape generally has a feature of being curved. Therefore, the regions shown in the accompanying drawings are schematic in nature, and their shapes are not intended to show actual shapes of the regions in a device, and are not intended to limit the scope of the exemplary embodiments.

Some embodiments of the present disclosure provide a display device. The display device may be a mobile phone, a tablet computer, a personal digital assistant (PDA), a vehicle-mounted computer, a wearable display device, etc.

Embodiments of the present disclosure do not particularly limit a specific form of the display device.

In some embodiments, as shown in FIG. 1, the display device 2 includes a display panel 1. The display panel 1 has a display area AA and a peripheral region S disposed on at least one side of the display area AA. In some examples, the peripheral region S surrounds the display area AA.

The display panel 1 includes a plurality of sub-pixels P that are located within the display area AA. The specific arrangement of the plurality of sub-pixels is not limited in the embodiments of the present disclosure, which can be designed according to actual needs. For example, the plurality of sub-pixels P are arranged in a matrix. In this case, sub-pixels P arranged in a line along a first direction X are referred to as a row of sub-pixels, and sub-pixels P arranged in a line in a second direction Y are referred to as a column of sub-pixels. For example, the first direction X and the second direction Y are perpendicular to each other.

The display panel 1 further includes a plurality of gate lines GL and a plurality of data lines DL. In some embodiments, an extending direction of the gate lines crosses an extending direction of the data lines. For example, the plurality of gate lines GL extend in the first direction X in FIG. 1, and the plurality of data lines DL extend in the second direction Y in FIG. 1. A gate line may be coupled to one row of sub-pixels to provide a gate scan signal to the row of sub-pixels. A data line may be coupled to one column of sub-pixels to provide a data signal to the column of sub-pixels.

In some embodiments, the display device is a self-luminous display device. For example, the display device is an OLED display device.

Figure 2:
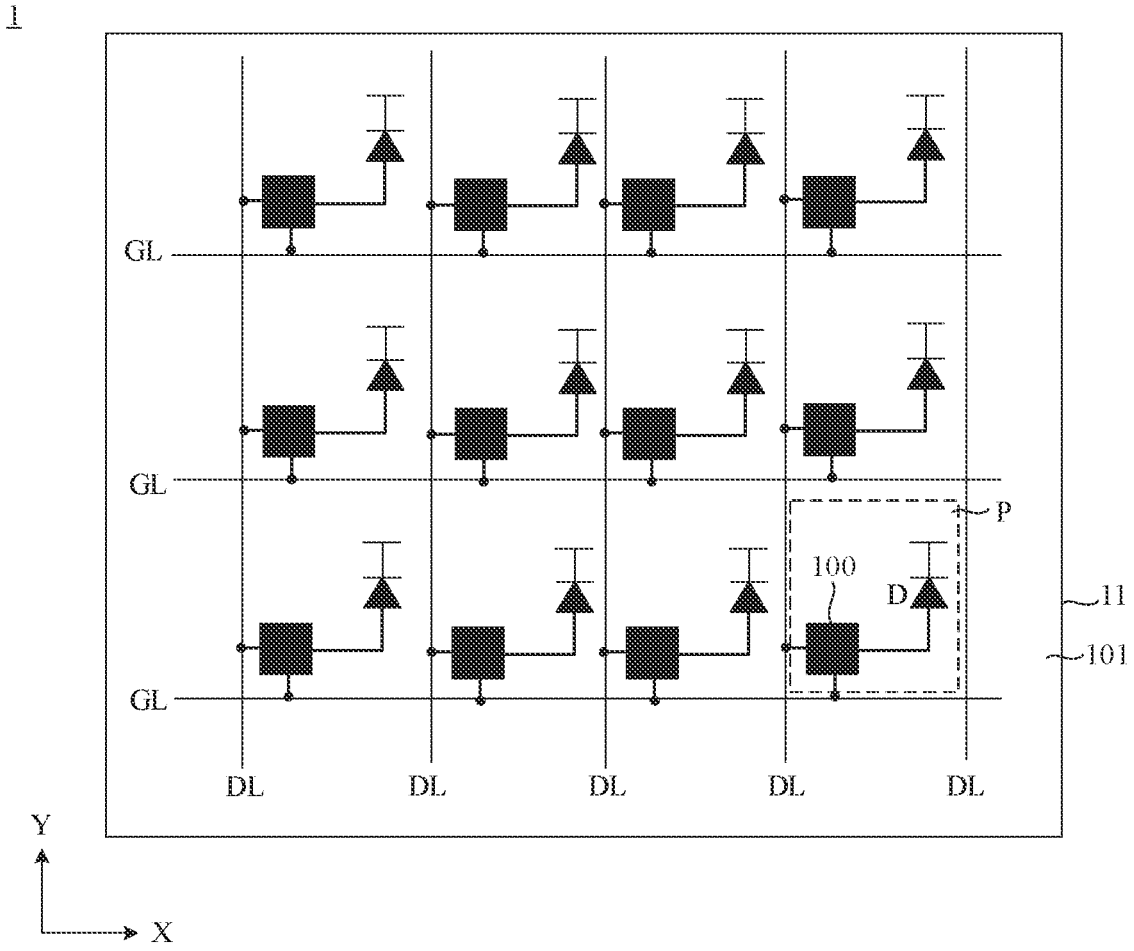
FIG. 2 is a structural diagram of a display panel, in accordance with some embodiments.

In some examples, as shown in FIG. 2, each sub-pixel P includes a pixel driving circuit 100 and a light-emitting device D. The pixel driving circuit 100 is coupled to the light-emitting device D. The pixel driving circuit 100 is further coupled to a gate line GL and a data line DL. Under control of the gate scan signal from the gate line GL, the pixel driving circuit 100 provides a driving signal (e.g., a driving current) to the light-emitting device D according to the data signal from the data line DL, so as to drive the light-emitting device D to emit light.

In some embodiments, as shown in FIG. 1, the display device 2 further includes a driver component 3 coupled to the display panel 1. The driver component 3 may provide signals to the display panel 1, so that the display panel 1 realizes display. For example, the driver component 3 may include a flexible printed circuit (FPC) and source driver(s) disposed on the FPC. For another example, the driver component is a driver chip.

In a case where the pixel driving circuit adopts low temperature poly silicon (LTPS) thin film transistors, since a leakage current of LTPS thin film transistor is high (e.g., the leakage current may reach $10^{-12}$ A), a gate voltage of a driver transistor of the pixel driving circuit may be continuously reduced during the light-emitting period. Consequently, the duration in which the driving transistor is turned on during the light-emitting period is shortened, and the brightness of the light-emitting device is reduced. In order to achieve the required brightness of the light-emitting device, the refresh frequency needs to be increased when displaying whether a dynamic image or a static image, resulting in an increase in power consumption of the display device.

Figure 3:
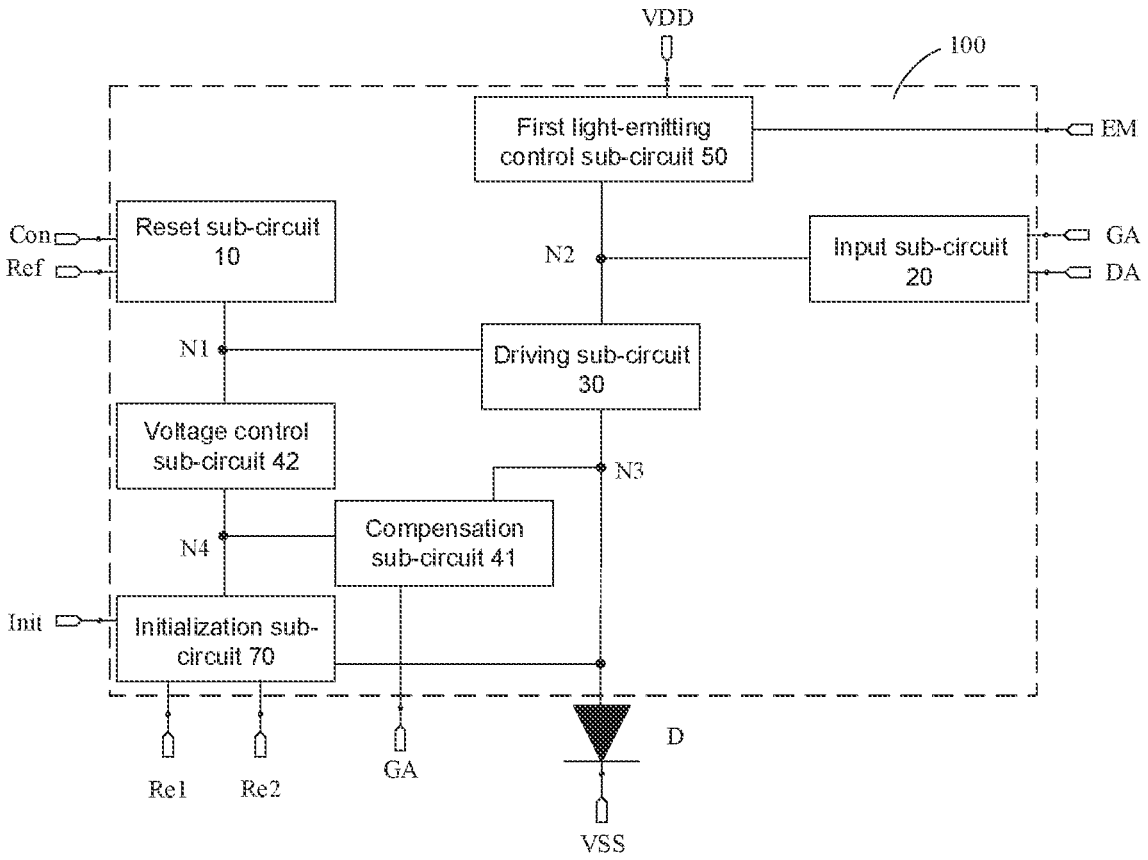
FIG. 3 is a block diagram of a pixel driving circuit, in accordance with some embodiments.
Figure 5:
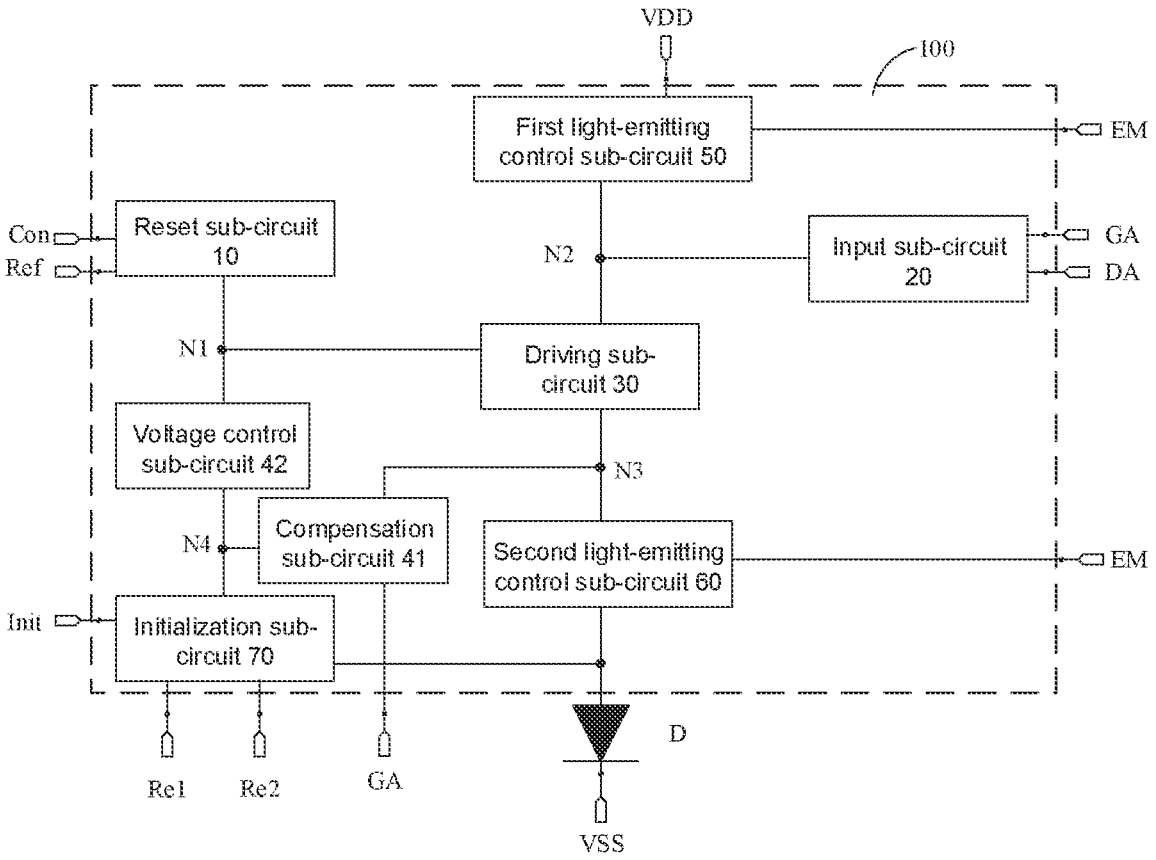
FIG. 5 is a block diagram of another pixel driving circuit, in accordance with some embodiments.

As shown in FIGS. 3 and 5, the pixel driving circuit 100 provided in some embodiments of the present disclosure includes a reset sub-circuit 10, an input sub-circuit 20, a driving sub-circuit 30, a compensation sub-circuit 41 and a voltage control sub-circuit 42.

The input sub-circuit 20 is coupled to a gate scan signal terminal GA, a data signal terminal DA and a second node N2. The driving sub-circuit 30 is coupled to a first node N1, the second node N2 and a third node N3. The compensation sub-circuit 41 is coupled to the gate scan signal terminal GA, the third node N3 and a fourth node N4. The voltage control sub-circuit 42 is coupled to the first node N1 and the fourth node N4. The reset sub-circuit 10 is coupled to a control signal terminal Con, a reference signal terminal Ref and the first node N1.

The reset sub-circuit 10 is configured to be turned on in response to an operating voltage of a control signal received at the control signal terminal Con, and transmit a reference voltage at the reference signal terminal Ref to the first node N1 to reset a voltage of the first node N1. In this way, it may be possible to prevent a residual signal of a previous frame from affecting a display effect of a current frame.

The input sub-circuit 20 is configured to transmit a data signal received at the data signal terminal DA to the second node N2, in response to a gate scan signal received at the gate scan signal terminal GA.

The driving sub-circuit 30 is configured to be turned on or turned off in response to a voltage of the first node N1; and to write the data signal and a compensation signal into the third node N3.

The compensation sub-circuit 41 is configured to transmit the data signal and the compensation signal to the fourth node N4 in response to the gate scan signal.

The voltage control sub-circuit 42 is configured to control the voltage of the first node N1 according to a voltage of the fourth node N4, and the driving sub-circuit 30 is further configured to output the driving signal according to the voltage of the first node N1, so as to drive the light-emitting device D coupled to the pixel driving circuit 100 to emit light.

The reset sub-circuit 10 is in a turn-off state under control of a non-operating voltage of the control signal during an operating period of the light-emitting device.

It will be noted that, the "operating voltage (or operating level)" of the control signal refers to a voltage (or level) that is capable of causing a transistor to be operated included in the reset sub-circuit 10 to be turned on. Accordingly, the "non-operating voltage (or non-operating level)" refers to a voltage (or level) that is not capable of causing the transistor to be operated included in the reset sub-circuit 10 to be turned on (i.e., the transistor is turned off). The transistor to be operated is a transistor coupled to the control signal terminal Con. Depending on factors such as a type (N-type or P-type) of the transistor in the reset sub-circuit 10, the operating voltage may be higher or lower than the non-operating voltage.

For example, if the transistor to be operated (e.g., a first transistor T1 in FIG. 4) included in the reset sub-circuit 10 is an N-type transistor, the "operating voltage" of the control signal is a high level, and the "non-operating voltage" is a low-level voltage. If the transistor to be operated included in the reset sub-circuit 10 is a P-type transistor, the operating voltage of the control signal is a low-level voltage, and the non-operating voltage is a high-level voltage.

In some examples, the display panel further includes control signal lines for transmitting control signals, and reference signal lines for transmitting the reference voltage. In this case, the control signal terminal Con is coupled to the control signal line to receive the control signal, and the reference signal terminal Ref is coupled to the reference signal line to receive the reference voltage.

In some embodiments, the display panel 1 includes gate lines GL for transmitting gate scan signals, and data lines DL for transmitting data signals, the gate scan signal terminal GA is coupled to the gate line GL to receive the gate scan signal, and the data signal terminal DA is coupled to the data line DL to receive the data signal.

In a case where the compensation sub-circuit 42 is directly coupled to the first node N1, due to presence of a leakage current of a transistor in the compensation sub-circuit 42, the voltage of the first node N1 will be affected. In this case, the turn-on duration of the driving sub-circuit 30 during the light-emitting period may be shortened, and thus the light-emitting duration of the light-emitting device D may be shortened.

In the pixel driving circuit 100 provided in the embodiments of the present disclosure, during the operating period of the light-emitting device D, the first node, which controls the driving sub-circuit to be turned on or off, is coupled to the voltage control sub-circuit. Since there is no leakage current in the voltage control sub-circuit 42, it may be possible to effective suppress the leakage of the first node N1, and the voltage of the first node N1 may be stably maintained for a long time. In this way, the light-emitting duration of the light-emitting device D may be extended, and the required brightness may thus be maintained without adopting a high refresh frequency when the display device 2 displays a static image. Therefore, the power consumption of the display device 2 may be reduced.

In some embodiments, as shown in FIG. 3, the pixel driving circuit further includes an initialization sub-circuit 70. The initialization sub-circuit 70 is coupled to a first reset signal terminal Re1, a second reset signal terminal Re2, an initialization signal terminal Init, the third node N3 and the fourth node N4. The third node N3 is further electrically connected to the light-emitting device D.

The initialization sub-circuit 70 is configured to: transmit an initialization signal received at the initialization signal terminal Init to the fourth node N4 to initialize the fourth node N4, in response to a first reset signal received at the first reset signal terminal Re1; and transmit the initialization signal to the light-emitting device D to initialize the light-emitting device D, in response to a second reset signal received at the second reset signal terminal Re2. In this way, it may be possible to prevent the signal remaining in the fourth node N4 in the previous frame from affecting the signal to be written into the fourth node N4 in the current frame, so as to ensure the stability of the voltage of the first node N1; and it may also be possible to prevent the signal remaining in the light-emitting device D in the previous frame from affecting the signal to be transmitted to the light-emitting device D in the current frame.

In some embodiments, the display panel further includes: first reset signal lines for transmitting first reset signals, second reset signal lines for transmitting second reset signals, and initialization signal lines for transmitting initialization signals. In this case, the first reset signal terminal may be coupled to the first reset signal line to receive the first reset signal, the second reset signal terminal may be coupled to the second reset signal line to receive the second reset signal, and the initialization signal terminal may be coupled to the initialization signal line to receive the initialization signal.

In some examples, the gate line is also used as the second reset signal line. For example, the second reset signal terminals of a row of pixel driving circuits are coupled to a gate line coupled to a previous row of pixel driving circuits. In this case, the number of signal lines is reduced.

In some other examples, the second reset signal terminal is coupled to an independent second reset signal line, which ensures the stability of the second reset signal.

In some embodiments, as shown in FIGS. 3 and 5, the pixel driving circuit 100 further includes a first light-emitting control sub-circuit 50. The first light-emitting control sub-circuit 50 is coupled to a light-emitting control signal terminal EM, a first voltage terminal VDD and the second node N2.

The first light-emitting control sub-circuit 50 is configured to transmit a first voltage received at the first voltage terminal VDD to the driving sub-circuit 30, in response to a light-emitting control signal received at the light-emitting control signal terminal EM. In this way, the driving sub-circuit may output the driving signal according to the first voltage, and the voltage of the first node N1 in the operating period of the light-emitting device D (e.g., the third period described below).

In some embodiments, as shown in FIG. 5, the pixel driving circuit 100 further includes a second light-emitting control sub-circuit 60. The second light-emitting control sub-circuit 60 is coupled to the light-emitting control signal terminal EM and the third node N3. The second light-emitting control sub-circuit 60 is configured to be further coupled to the light-emitting device D.

The second light-emitting control sub-circuit 60 is further configured to make the driving sub-circuit 30 and the light-emitting device D form a conductive path, in response to the light-emitting control signal received at the light-emitting control signal terminal EM. In this way, the second light-emitting control sub-circuit 60 can transmit the driving signal to the light-emitting device D to drive the light-emitting device D to emit light.

In some examples, the first voltage terminal VDD is configured to transmit the first voltage. The first voltage may be a direct current (DC) voltage. For example, the display panel 1 further includes first voltage lines for transmitting the first voltage. The first voltage terminal is coupled to the first voltage line to receive the first voltage. The first voltage may be a DC high-level voltage, or a DC low-level voltage. For example, the second light-emitting control sub-circuit 60 is coupled to a first electrode (e.g., anode) of the light-emitting device D, and the first voltage is a DC high-level voltage. That is, the first voltage terminal VDD is configured to transmit the DC high-level voltage.

It will be noted that, in a period where the light-emitting control signal is at the operating voltage (i.e., an active level), the light-emitting device may be considered to be in the operating period or a light-emitting period (e.g., a third period in a frame period described below). It can be understood that, in the operating period of the light-emitting device, there may be a case that the driving signal cannot make the light-emitting device to emit light. That is, the driving signal received by the light-emitting device cannot cause the light-emitting device to be turned on; in this case, the light-emitting device displays zero away scale.

In some embodiments, referring to FIGS. 3 and 5, the light-emitting device D is further coupled to a second voltage terminal VSS. For example, the first electrode of the light-emitting device D is coupled to the pixel driving circuit 100, and a second electrode of the light-emitting device D is coupled to the second voltage terminal VSS.

In some examples, the second voltage terminal VSS is configured to transmit a second voltage. The second voltage may be a DC voltage. For example, the display panel 1 further includes second voltage lines for transmitting the second voltage. The second voltage terminal is coupled to the second voltage line to receive the second voltage. The second voltage may be a DC low-level voltage, or a DC high-level voltage. In a case where the second voltage terminal VSS is coupled to the second electrode (e.g., cathode) of the light-emitting device D, the second voltage is a DC low-level voltage. That is, the second voltage terminal VSS is configured to transmit DC low-level voltage. For example, the second voltage terminal VSS may be a ground terminal.

In some examples, the display panel further includes light-emitting control signal lines for transmitting light-emitting control signals. The light-emitting control signal terminal is coupled to the light-emitting control signal line to receive the light-emitting control signal. For example, the light-emitting control signal lines extend in a same direction as the gate lines. For example, a row of pixel driving circuits are coupled to a single light-emitting control signal line.

In some embodiments, as shown in FIG. 5, the pixel driving circuit 100 further includes the second light-emitting control sub-circuit 60, and the second light-emitting control sub-circuit 60 is configured to be coupled to the light-emitting device D. On this basis, the pixel driving circuit 100 further includes an initialization sub-circuit 70. The initialization sub-circuit 70 is coupled to a first reset signal terminal Re1, a second reset signal terminal Re2, an initialization signal terminal Init, and the fourth node N4. The initialization sub-circuit 70 is configured to be further coupled to the light-emitting device D.

The initialization sub-circuit 70 is further configured to: transmit an initialization signal received at the initialization signal terminal Init to the fourth node N4 to initialize fourth node N4, in response to a first reset signal received at the first reset signal terminal Re1; and transmit the initialization signal to the light-emitting device D to initialize the light-emitting device D, in response to a second reset signal received at the second reset signal terminal Re2.

In some embodiments, the display panel further includes: first reset signal lines for transmitting first reset signals, second reset signal lines for transmitting second reset signals, and initialization signal lines for transmitting initialization signals. For the second reset signal line, reference may be made to the above description, which will not be repeated herein.

A specific structure of each sub-circuit in the pixel driving circuit will be described below.

Figure 4:
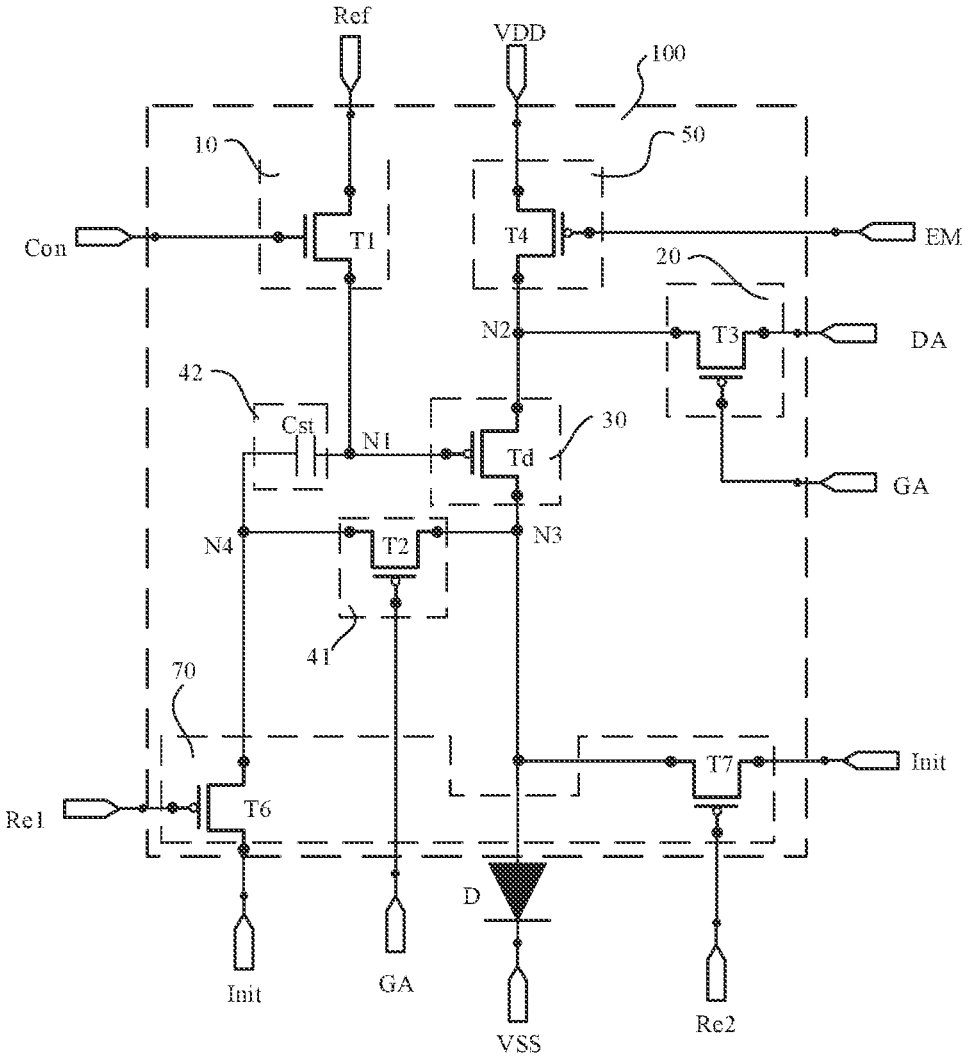
FIG. 4 is a structural diagram of a pixel driving circuit, in accordance with some embodiments.
Figure 6:
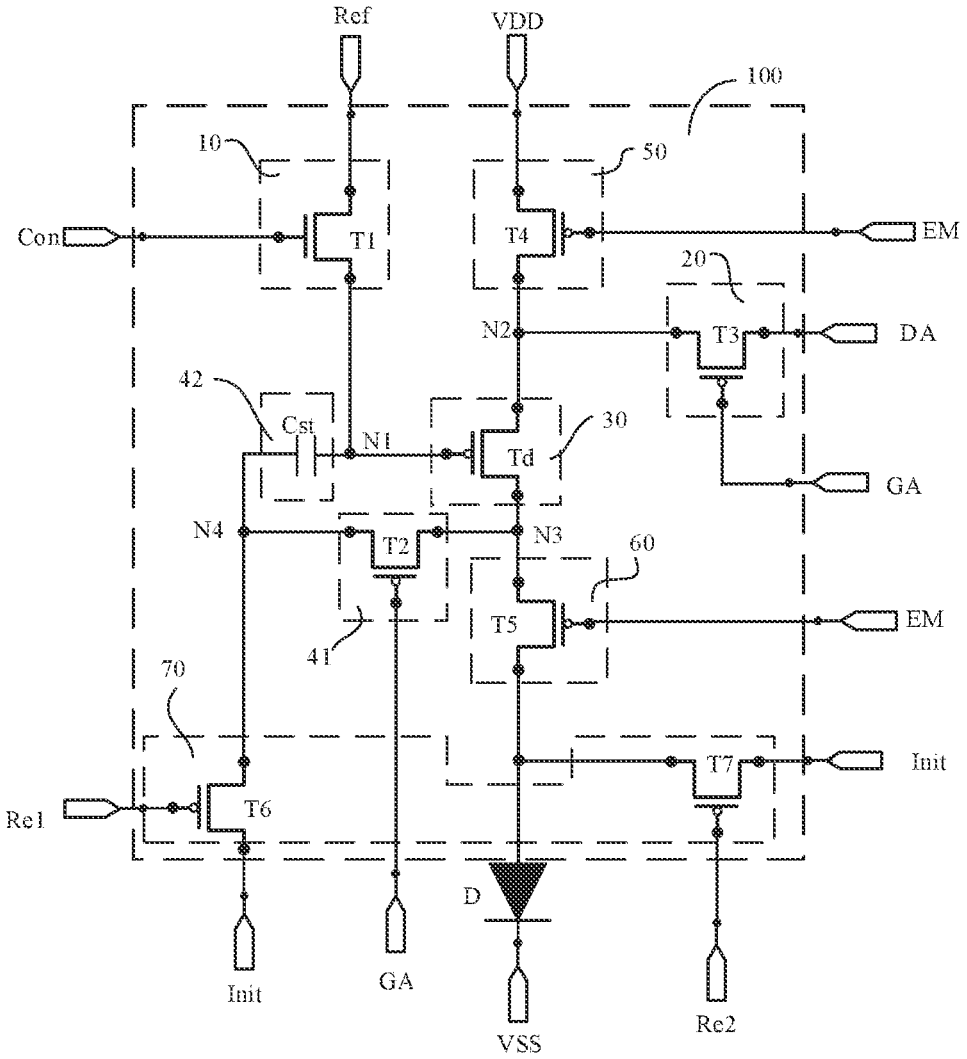
FIG. 6 is a structural diagram of another pixel driving circuit, in accordance with some embodiments.

In some embodiments, as shown in FIGS. 4 and 6, the reset sub-circuit 10 includes a first transistor T1. A control electrode of the first transistor T1 is coupled to the control signal terminal Con, a first electrode of the first transistor T1 is coupled to the reference signal terminal Ref, and a second electrode of the first transistor T1 is coupled to the first node N1.

In some examples, the first transistor T1 is an oxide thin film transistor. For the first node N1 that is capable of controlling a driving transistor (e.g., a driving transistor Td described below) in the pixel driving circuit to be turned on or off, its main leakage path is the first transistor T1. Since the oxide thin film transistor has a low leakage current, in the operating period of the light-emitting device, by controlling the first transistor T1 to be turned off, it may be possible to effectively block the leakage of the first node N1. As a result, the turn-on duration of the driving transistor may be extended, and the light-emitting duration of the light-emitting device D may be extended.

In this way, when the display device displays a static image, a low refresh frequency can be adopted for driving, which reduces the power consumption of the display device. For example, when a display device adopting the pixel driving circuit provided in the embodiments of the present disclosure displays a static image, the refresh frequency of the display panel may be 1 Hz. Therefore, the solution provided in the embodiments of the present disclosure may be able to reduce the refresh frequency for displaying a static image.

In some embodiments, as shown in FIGS. 4 and 6, the compensation sub-circuit 41 includes a second transistor T2. A control electrode of the second transistor T2 is coupled to the gate scan signal terminal GA, a first electrode of the second transistor T2 is coupled to the third node N3, and a second electrode of the second transistor T2 is coupled to the fourth node N4.

In some embodiments, as shown in FIGS. 4 and 6, the voltage control sub-circuit 42 includes a storage capacitor Cst. A first terminal of the storage capacitor Cst is coupled to the fourth node N4, and a second terminal of the storage capacitor Cst is coupled to the first node N1.

Since the first terminal, instead of the second terminal, of the storage capacitor Cst is coupled to the second transistor T2, the leakage path of the first node N1 is mainly concentrated on a path from the first node N1 to the first transistor T1. On this basis, by using an oxide transistor as the first transistor T1, the effect of preventing leakage may be achieved.

In some embodiments, as shown in FIGS. 4 and 6, the input sub-circuit 20 includes a third transistor T3. A control electrode of the third transistor T3 is coupled to the gate scan signal terminal GA, a first electrode of the third transistor T3 is coupled to the data signal terminal DA, and a second electrode of the third transistor T3 is coupled to the second node N2.

In some embodiments, as shown in FIGS. 4 and 6, the driving sub-circuit 30 includes a driving transistor Td. A control electrode of the driving transistor Td is coupled to the first node N1, a first electrode of the driving transistor Td is coupled to the second node N2, and a second electrode of the driving transistor Td is coupled to the third node N3.

In some embodiments, as shown in FIGS. 4 and 6, the first light-emitting control sub-circuit 50 includes a fourth transistor T4. A control electrode of the fourth transistor T4 is coupled to the light-emitting control signal terminal EM, a first electrode of the fourth transistor T4 is coupled to the first voltage terminal VDD, and a second electrode of the fourth transistor T4 is coupled to the second node N2.

In some embodiments, as shown in FIG. 6, the second light-emitting control sub-circuit 60 includes a fifth transistor T5. A control electrode of the fifth transistor T5 is coupled to the light-emitting control signal terminal EM, a first electrode of the fifth transistor T5 is coupled to the third node N3, and a second electrode of the fifth transistor T5 is configured to be coupled to the light-emitting device D.

In some other embodiments, as shown in FIG. 4, there is no second light-emitting control sub-circuit 60 in the pixel driving circuit 100. In this case, the third node N3 is directly coupled to the light-emitting device D (e.g., the first electrode of the light-emitting device D).

In some embodiments, as shown in FIGS. 4 and 6, the initialization sub-circuit 70 includes a sixth transistor T6 and a seventh transistor T7. A control electrode of the sixth transistor T6 is coupled to the first reset signal terminal Re1, a first electrode of the sixth transistor T6 is coupled to the initialization signal terminal Init, and a second electrode of the sixth transistor T6 is coupled to the fourth node N4. A control electrode of the seventh transistor T7 is coupled to the second reset signal terminal Re2, a first electrode of the seventh transistor T7 is coupled to the initialization signal terminal Init, and a second electrode of the seventh transistor T7 is configured to be coupled to the light-emitting device D (e.g., the first electrode of the light-emitting device D).

In some examples, the compensation sub-circuit 41 includes the second transistor T2, the voltage control sub-circuit 42 includes the storage capacitor Cst, and the second electrode of the sixth transistor T6 is coupled to the first terminal of the storage capacitor Cst and the second electrode of the second transistor T2.

In some examples, the second transistor T2, the third transistor T3, the fourth transistor T4, the fifth transistor T5, the sixth transistor T6, the seventh transistor T7 and the driving transistor Td are all LTPS thin film transistors. Since the carrier mobility of the LTPS thin film transistors is high, it may be ensured that the pixel driving circuit 100 has good driving performance.

Referring to FIG. 6, a specific structure of the pixel driving circuit 100 will be described below. The pixel driving circuit 100 adopts an 8T1C structure. Herein, "T" represents a transistor, "C" represents a capacitor; therefore, "8T1C" means that the pixel driving circuit 100 includes eight transistors and one capacitor.

The pixel driving circuit 100 includes the reset sub-circuit 10, the input sub-circuit 20, the driving sub-circuit 30, the compensation sub-circuit 41, the voltage control sub-circuit 42, the first light-emitting control sub-circuit 50, the second light-emitting control sub-circuit 60 and the initialization sub-circuit 70.

The reset sub-circuit 10 includes the first transistor T1. The compensation sub-circuit 41 includes the second transistor T2. The voltage control sub-circuit 42 includes the storage capacitor Cst. The input sub-circuit 20 includes the third transistor T3. The driving sub-circuit 30 includes the driving transistor Td. The first light-emitting control sub-circuit 50 includes the fourth transistor T4. The second light-emitting control sub-circuit 60 includes the fifth transistor T5. The initialization sub-circuit 70 includes the sixth transistor T6 and the seventh transistor T7.

The control electrode of the driving transistor Td is coupled to the first node N1, the first electrode of the driving transistor Td is coupled to the second node N2, and the second electrode of the driving transistor Td is coupled to the third node N3.

The control electrode of the first transistor T1 is coupled to the control signal terminal Con, the first electrode of the first transistor T1 is coupled to the reference signal terminal Ref, and the second electrode of the first transistor T1 is coupled to the first node N1.

The control electrode of the third transistor T3 is coupled to the gate scan signal terminal GA, the first electrode of the third transistor T3 is coupled to the data signal terminal DA, and the second electrode of the third transistor T3 is coupled to the second node N2.

The control electrode of the second transistor T2 is coupled to the gate scan signal terminal GA, the first electrode of the second transistor T2 is coupled to the third node N3, and the second electrode of the second transistor T2 is coupled to the fourth node N4.

The first terminal of the storage capacitor Cst is coupled to the fourth node N4, and the second terminal of the storage capacitor Cst is coupled to the first node N1.

The control electrode of the fourth transistor T4 is coupled to the light-emitting control signal terminal EM configured to provide the light-emitting control signal, the first electrode of the fourth transistor T4 is coupled to the first voltage terminal VDD configured to provide the first voltage, and the second electrode of the fourth transistor T4 is coupled to the second node N2.

The control electrode of the fifth transistor T5 is coupled to the light-emitting control signal terminal EM, the first electrode of the fifth transistor T5 is coupled to the third node N3, and the second electrode of the fifth transistor T5 is configured to be coupled to the first electrode of light-emitting device D. The second electrode of light-emitting device D is coupled to the second voltage terminal VSS.

The control electrode of the sixth transistor T6 is coupled to the first reset signal terminal Re1 configured to provide the first reset signal, the first electrode of the sixth transistor T6 is coupled to the initialization signal terminal Init configured to provide the initialization signal, and the second electrode of the sixth transistor T6 is coupled to the first terminal of the storage capacitor. The control electrode of the seventh transistor T7 is coupled to the second reset signal terminal Re2 configured to provide the second reset signal, the first electrode of the seventh transistor T7 is coupled to the initialization signal terminal Init, and the second electrode of the seventh transistor T7 is configured to be coupled to the first electrode of light-emitting device D.

In some examples, an on-off type of the first transistor T1 is opposite to an on-off type of the second transistor T2, the third transistor T3, the fourth transistor T4, the fifth transistor T5, the sixth transistor T6, the seventh transistor T7, and the driving transistor Td. For example, the first transistor T1 is an N-type transistor, and the second transistor T2, the third transistor T3, the fourth transistor T4, the fifth transistor T5, the sixth transistor T6, the seventh transistor T7 and the driving transistor Td are all P-type transistors. Or, the first transistor T1 is a P-type transistor, and the second transistor T2, the third transistor T3, the fourth transistor T4, the fifth transistor T5, the sixth transistor T6, the seventh transistor T7 and the driving transistor Td are all N-type transistors.

In some examples, the first transistor T1 is an oxide thin film transistor, which may improve the effect of the first transistor T1 in preventing the leakage of the first node N1. The second transistor T2, the third transistor T3, the fourth transistor T4, the fifth transistor T5, the sixth transistor T6, the seventh transistor T7 and the driving transistor Td are all LTPS thin film transistors, which may ensure that the pixel driving circuit 100 has a high carrier mobility, and thus ensure that it has a high driving efficiency.

For example, the first transistor T1 is an N-type oxide thin film transistor, and the second transistor T2, the third transistor T3, the fourth transistor T4, the fifth transistor T5, the sixth transistor T6, the seventh transistor T7 and the driving transistor Td are all P-type LTPS thin film transistors.

For example, the first transistor is an oxide thin film transistor and the other transistors are all LTPS thin film transistors, the first transistor may adopt a top-gate, bottom-gate or double-gate design. Herein, "top-gate" means that, in a thickness direction of a base substrate on which the pixel driving circuit is provided, and along a direction moving away from the base substrate, a thin film transistor includes an active layer, a gate insulating layer, a gate, an interlayer dielectric layer, and a source and a drain (the source and the drain are arranged in a same layer), which are sequentially arranged on the base substrate. That is, the gate is more proximate to the source and the drain than the active layer. "Bottom-gate" means that, in the thickness direction of the base substrate on which the pixel driving circuit is provided, and along the direction moving away from the base substrate, a thin film transistor includes a gate, a gate insulating layer, an active layer, and a source and a drain (the source and the drain are arranged in a same layer), which are sequentially arranged on the base substrate. That is, the gate is farther away from the source and the drain than the active layer. "Double-gate" means that a thin film transistor includes two gates. For example, in the thickness direction of the base substrate on which the pixel driving circuit is provided, and along the direction moving away from the base substrate, the thin film transistor with the double-gate design includes a first gate, a first insulating layer, an active layer, a source and a drain (the source and the drain are arranged in a same layer), a second insulating layer, and a second gate, which are sequentially arranged on the base substrate.

In a case where the first transistor adopts the double-gate design, the second gate may not only be able to form a storage capacitor with the active layer and serve as the second gate of the transistor to improve the performance of the transistor, but may also be able to shield the active layer and prevent the active layer from being exposed to light to generate photo-generated carriers.

For example, the first transistor is an oxide thin film transistor and the other transistors are all LTPS thin film transistors, in a process of fabricating the pixel driving circuit on the base substrate, the LTPS thin film transistors may be fabricated first, and then the oxide thin film transistor is fabricated.

It will be noted that transistors in the pixel driving circuit provided in the embodiments of the present disclosure may be thin film transistors, field effect transistors or other switching devices with like characteristics. The embodiments of the present disclosure are described by taking an example where the transistors are thin film transistors.

In some embodiments, a control electrode of each transistor in the pixel driving circuit is a gate of the transistor, a first electrode of each transistor is one of a source and a drain of the transistor, and a second electrode of each transistor is another of the source and the drain of the transistor. Since the source and the drain of the transistor may be symmetrical in structure, there may be no difference in structure between the source and the drain of the transistor. That is to say, there may be no difference in structure between the first electrode and the second electrode of the transistor in the embodiments of the present disclosure. For example, the transistor is a P-type transistor, the first electrode of the transistor is the source, and the second electrode thereof is the drain. For another example, the transistor is an N-type transistor, the first electrode of the transistor is the drain, and the second electrode thereof is the source.

In the embodiments of the present disclosure, specific implementation manners of the reset sub-circuit 10, the input sub-circuit 20, the driving sub-circuit 30, the compensation sub-circuit 41, the voltage control sub-circuit 42, the first light-emitting control sub-circuit 50, the second light-emitting control sub-circuit 60 and the initialization sub-circuit 70 are not limited to the manners described above, and may be other implementation manners used, such as conventional connection manners well known to a person skilled in the art, as long as the realization of corresponding functions is ensured. The above examples do not limit the protection scope of the present disclosure. In practical applications, a person skilled in the art may choose to use or not to use one or more of the above circuits according to situations. Various combinations and variations based on the above circuits do not depart from the principle of the present disclosure, and details are not repeated here.

Some embodiments of the present disclosure provide a driving method for the pixel driving circuit 100 described above. In some examples, referring to FIGS. 3 and 5, the pixel driving circuit 100 includes: the reset sub-circuit 10, the input sub-circuit 20, the driving sub-circuit 30, the compensation sub-circuit 41 and the voltage control sub-circuit 42.

Figure 7A:
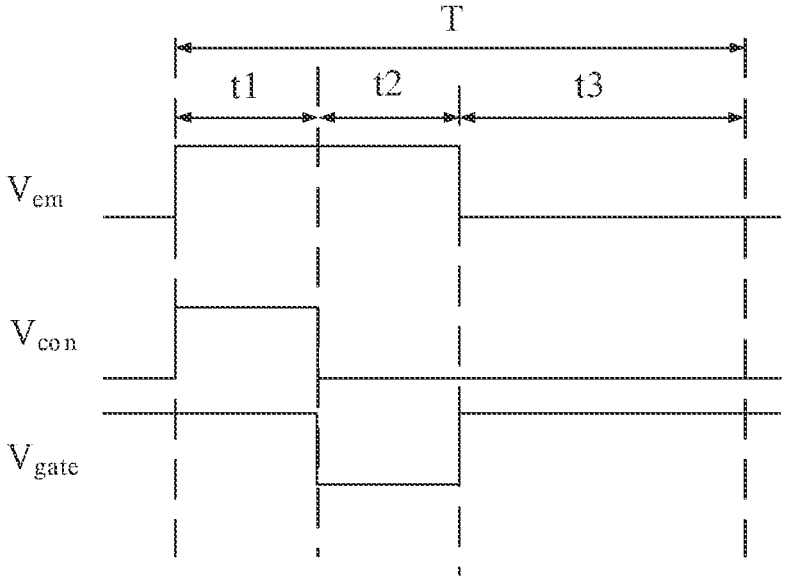
FIG. 7A is a signal timing diagram of a pixel driving circuit, in accordance with some embodiments.
Figure 7B:
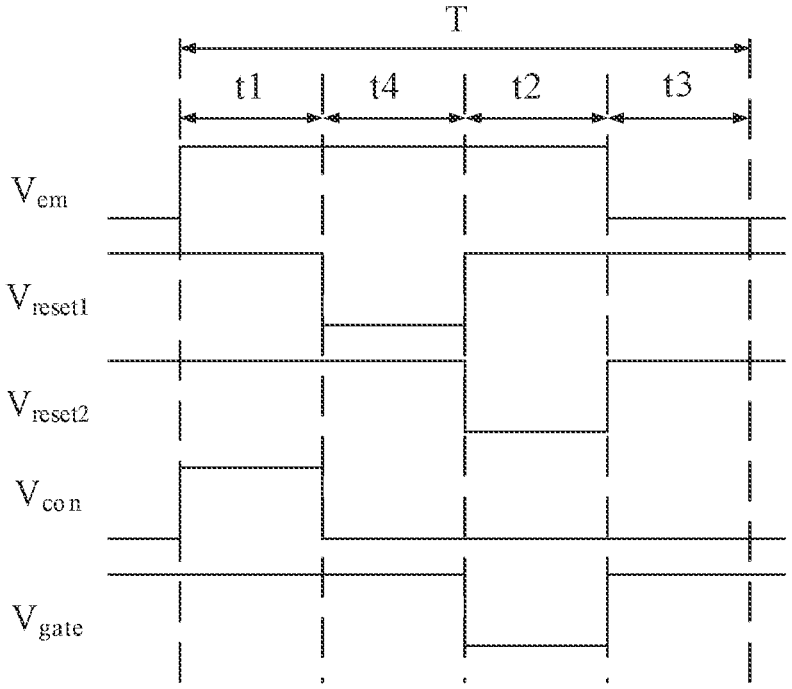
FIG. 7B is another signal timing diagram of a pixel driving circuit, in accordance with some embodiments.

For example, referring to FIGS. 7A and 7B, in a frame period, the operating period T of the pixel driving circuit includes a first period t1, a second period t2, and a third period t3.

The driving method includes the following steps.

In the first period t1, the reset sub-circuit 10 is turned on in response to the operating voltage (i.e., the effective level) of the control signal $V_{con}$, received at the control signal terminal Con, and transmits the reference voltage received at the reference signal terminal Ref to the first node N1 to reset the voltage of the first node N1, so as to prevent the residual signal of the previous frame from affecting the display effect of the current frame.

In the second period t2, the input sub-circuit 20 transmits the data signal received at the data signal terminal DA to the second node N2, in response to the gate scan signal $V_{gate}$ received at the gate scan signal terminal GA; the driving sub-circuit 30 writes the data signal and the compensation signal into the third node N3; and the compensation sub-circuit 41 transmits the data signal and the compensation signal to the fourth node N4, in response to the gate scan signal $V_{gate}$; the voltage control sub-circuit 42 controls the voltage of the first node N1 according to the voltage of the fourth node N4.

In the third period t3, the driving sub-circuit 30 outputs the driving signal according to the voltage of the first node N1, so as to drive the light-emitting device D to emit light.

In some examples, as shown in FIG. 3, the pixel driving circuit 100 further includes the first light-emitting control sub-circuit 50. Based on this, referring to FIGS. 7A and 7B, in the third period t3, the first light-emitting control sub-circuit 50 transmits the first voltage of the first voltage terminal VDD to the second node N2 (i.e., the driving sub-circuit 30), in response to the light-emitting control signal $V_{em}$ received at the light-emitting control signal terminal EM; and the driving sub-circuit 30 outputs the driving signal according to the first voltage and the voltage of the first node N1 controlled by the voltage control sub-circuit 42 according to the voltage the fourth node N4, so as to drive the light-emitting device D to emit light.

In some examples, as shown in FIG. 5, the pixel driving circuit 100 further includes the second light-emitting control sub-circuit 60. Based on this, referring to FIGS. 7A and 7B, in the third period t3, the second light-emitting control sub-circuit 60 makes the driving sub-circuit 30 and the light-emitting device D form a conductive path, in response to the light-emitting control signal $V_{em}$, received at the light-emitting control signal terminal EM; and the second light-emitting control sub-circuit 60 transmits the driving signal to the light-emitting device D to drive the light-emitting device D to emit light.

In some examples, referring to FIGS. 3 and 5, the pixel driving circuit 100 further includes the initialization sub-circuit 70. Referring to FIG. 7B, in the frame period, the operating period T of the pixel driving circuit may further include a fourth period t4. The fourth period t4 may be between the first period t1 and the second period t2. The driving method further includes the following steps: in the fourth period t4, the initialization sub-circuit 70 transmits the initialization signal received at the initialization signal terminal nit to the fourth node N4 to initialize the fourth node N4, in response to the first reset signal $V_{reset1}$ received at the first reset signal terminal Re1; in the second period t2, the initialization sub-circuit 70 transmits the initialization signal to the light-emitting device D to initialize the light-emitting device D, in response to the second reset signal $V_{reset2}$ received at the second reset signal terminal Re2.

In this case, in the fourth period t4, the voltage of the fourth node N4 is the voltage of the initialization signal. Since the voltage of the first node N1 is the reference voltage in a previous period of the fourth period t4 (i.e., the first period t1), and the voltage of the first node N1 is controlled by the voltage control sub-circuit 42 according to the voltage of the fourth node N4, the voltage $V_{N1}$ of the first node N1 in the fourth period t4 becomes a sum of the reference voltage $V_{init}$ and the voltage of the initialization signal $V_{ref}$ (i.e., $V_{N1}=V_{init}+V_{ref}$).

In combination with the timing diagram of FIG. 7B, a driving process of the pixel driving circuit 100 is described in detail below by taking the 8T1C pixel driving circuit 100 shown in FIG. 6 as an example. The driving transistor Td in the pixel driving circuit 100 is an N-type transistor, and all other transistors in the pixel driving circuit 100 are P-type transistors.

The first voltage $V_{dd}$ of the first voltage terminal VDD is a DC high-level voltage, the second voltage $V_{ss}$ of the second voltage terminal VSS is a DC low-level voltage, and the initialization signal of the initialization signal terminal Init is a low-level voltage.

Referring to FIG. 7B, in a frame period, the operating period T of the pixel driving circuit may include the first period t1, the second period t2, the third period t3, and the fourth period t4.

Figure 8:
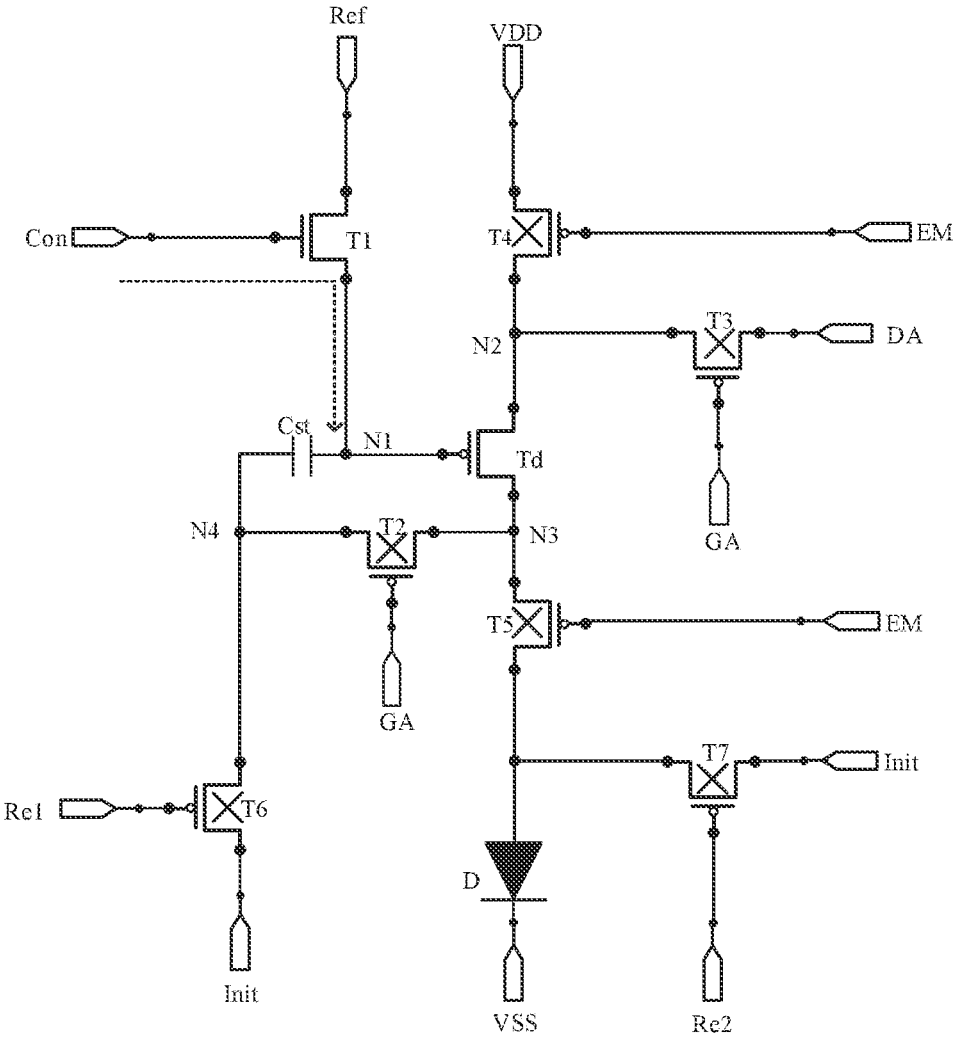
FIGS. 8 to 11 are diagrams showing a driving process of a pixel driving circuit, in accordance with some embodiments.

In the first period t1, as shown in FIG. 8, the first transistor T1 is in a turn-on state, in response to a high-level voltage of the control signal $V_{con}$ received at the control signal terminal Con. The first transistor T1 transmits the reference voltage received at the reference signal terminal Ref to the first node N1 to reset the voltage of the first node N1, thereby preventing the signal remaining in the storage capacitor Cst in the previous frame from affecting the image displayed in the current frame.

In this case, a voltage $V_g$ of the gate (e.g., control electrode) of the driving transistor Td is the reference voltage $V_{ref}$, a voltage $V_s$ of the source (e.g., the first electrode) is kept at the voltage of the previous period. That is, the voltage $V_s$ of the source is the first voltage $V_{dd}$, and the gate-source voltage difference $V_{gs}$ of the driving transistor Td is the difference between the reference voltage $V_{ref}$ and the first voltage $V_{dd}$ (i.e., $V_{gs}=V_{ref}-V_{dd}$). In order to write the data signal and the compensation signal into the first node N1 (i.e., the control electrode of the driving transistor Td) in the second period, the driving transistor Td needs to be turned on in the first period. Since the driving transistor Td is a P-type transistor, it needs to be ensured that the gate-source voltage difference $V_{gs}$ of the driving transistor is less than the threshold voltage $V_{th}$ of the driving transistor. That is, it needs to be ensured that the difference between the reference voltage and the first voltage is less than the threshold voltage $V_{th}$ of the driving transistor. In other words, the reference voltage needs to be less than the sum of the first voltage $V_{dd}$ and the threshold voltage $V_{th}$.

Base on this, an absolute value of a difference between the reference voltage $V_{ref}$ and the first voltage $V_{dd}$ is greater than an absolute value of the threshold voltage $V_{th}$ of the driving transistor Td.

In addition, in the first period t1, the sixth transistor T6 is turned off, in response to a high-level voltage of the first reset signal $V_{reset1}$ received at the first reset signal terminal Re1. The seventh transistor T1 is turned off, in response to a high-level voltage of the second reset signal $V_{reset2}$ received at the second reset signal terminal Re2. The second transistor T2 and the third transistor T3 are both turned off, in response to a high-level voltage of the gate scan signal $V_{gate}$ received at the gate scan signal terminal GA. The fourth transistor T4 and the fifth transistor T5 are turned off, in response to a high-level voltage of the light-emitting control signal $V_{em}$ received at the light-emitting control signal terminal EM.

Figure 9:
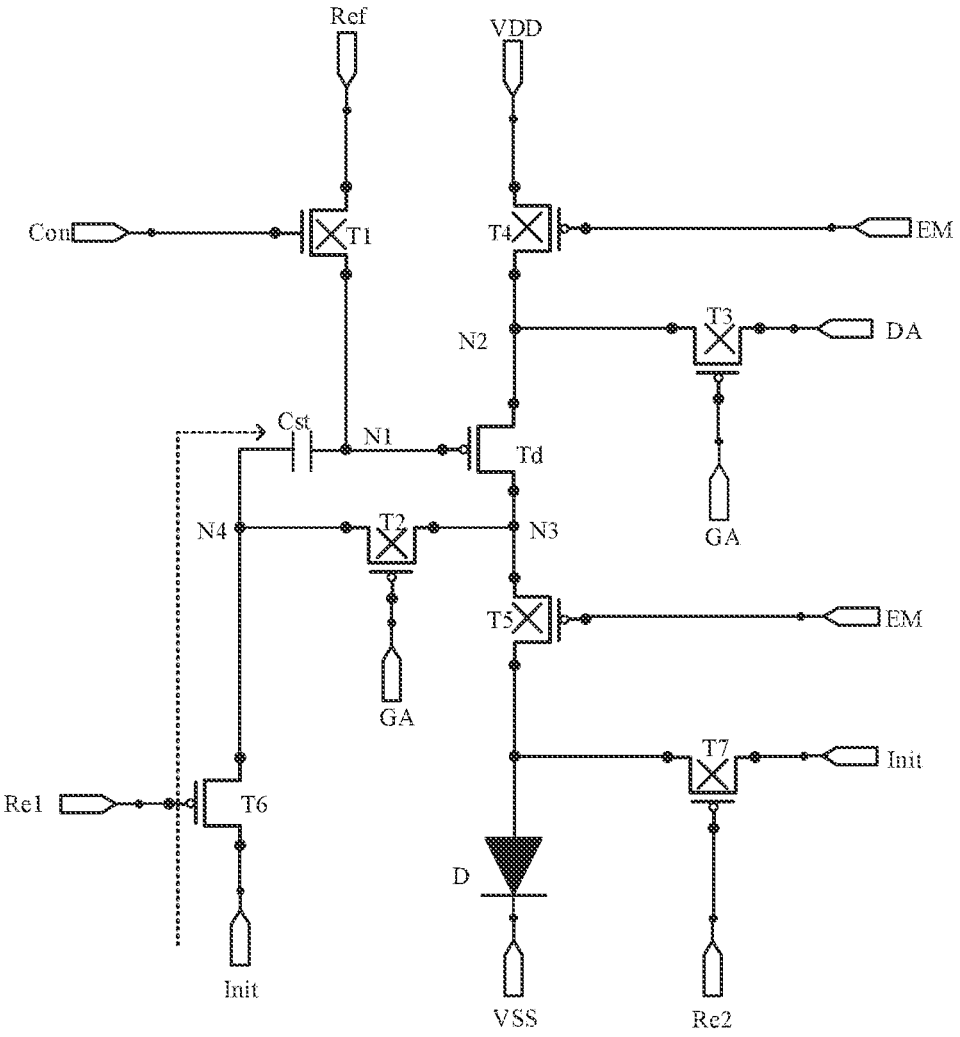

In the fourth period t4, as shown in FIG. 9, the sixth transistor T6 is turned on, in response to a low-level voltage of the first reset signal $V_{reset1}$ received at the first reset signal terminal Re1. The sixth transistor T6 transmits the initialization signal received at the initialization signal terminal Init to the fourth node N4. Thus, a voltage of the first terminal of the storage capacitor Cst is the voltage $V_{init}$ of the initialization signal. In the first period t1, a voltage of the second terminal of the storage capacitor Cst is the reference voltage $V_{ref}$. Due to a capacitive coupling effect of the storage capacitor Cst, in the fourth period t4, the voltage $V_g$ of the gate of the driving transistor Td (i.e., the voltage $V_{N1}$ of the first node N1, which is also the voltage of the second terminal of the storage capacitor Cst) is equal to the sum of the reference voltage $V_{ref}$ and the voltage $V_{init}$ of the initialization signal (i.e., $V_g=V_{N1}=V_{init}+V_{ref}$). In this case, the voltage $V_s$ of the source of the driving transistor Td is the first voltage $V_{dd}$, and the gate-source voltage difference $V_{gs}$ of the driving transistor Td is the difference between the voltage $V_g$ of the gate of the driving transistor Td and the first voltage $V_{dd}$ (i.e., $V_{gs}=V_{init}+V_{ref}-V_{dd}$), and the gate-source voltage difference $V_{gs}$ is smaller than the threshold voltage $V_{th}$, so that the driving transistor Td is maintained in the turn-on state in preparation for writing the compensation signal in a subsequent step.

In addition, in the fourth period t4, the first transistor T1 is turned off, in response to a low-level voltage of the control signal received at the control signal terminal Con. The seventh transistor T7 is turned off, in response to the high-level voltage of the second reset signal $V_{reset2}$ received at the second reset signal terminal Re2. The second transistor T2 and the third transistor T3 are both turned off, in response to the high-level voltage of the gate scan signal $V_{gate}$ received at the gate scan signal terminal GA. The fourth transistor T4 and the fifth transistor T5 are turned off, in response of the high-level voltage of the light-emitting control signal $V_{em}$ received at the light-emitting control signal terminal EM.

Figure 10:
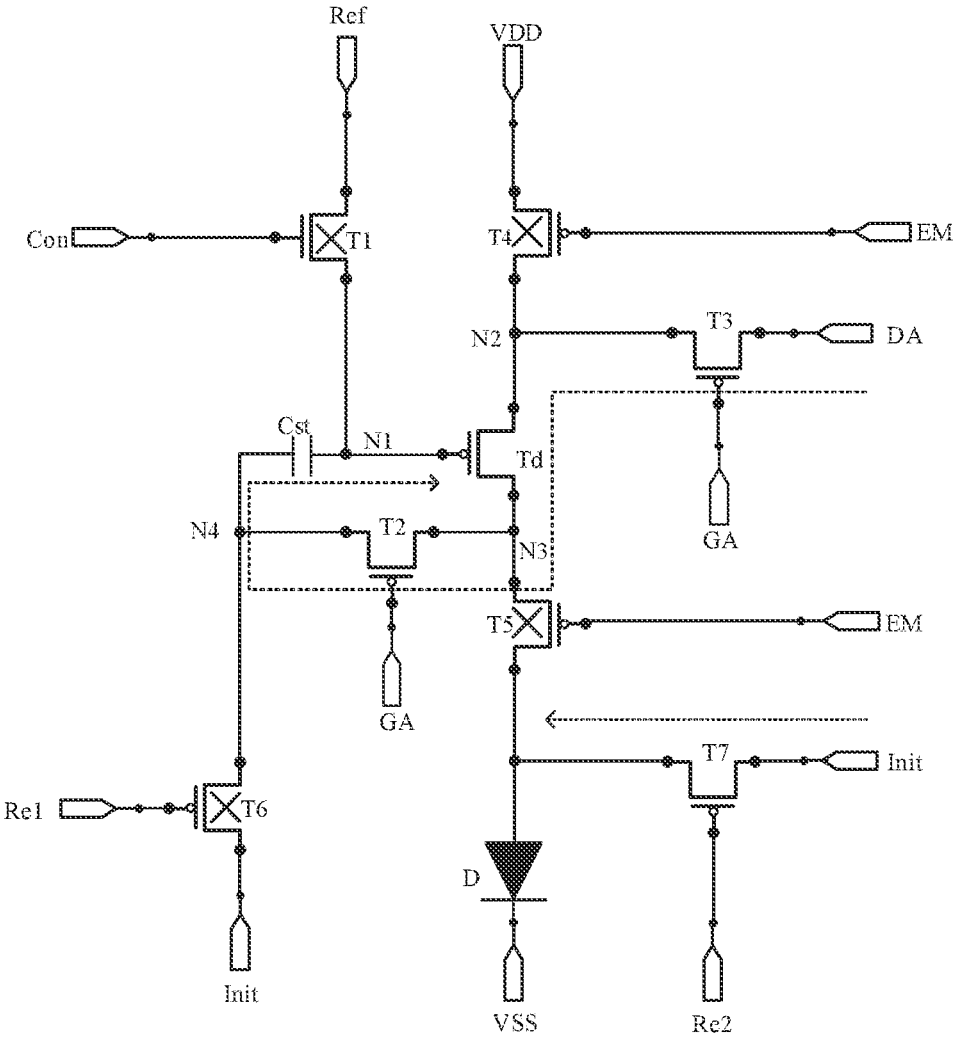

In the second period t2, as shown in FIG. 10, the second transistor T2 and the third transistor T3 are both turned on, in response to a low-level voltage of the gate scan signal $V_{gate}$ received at the gate scan signal terminal GA.

The third transistor T3 transmits the data signal received at the data signal terminal DA to the second node N2. Since the driving transistor Td is in the turn-on state at the end of a previous period of the second period t2 (e.g., the fourth period t4), the driving transistor Td writes the data signal and the threshold voltage $V_{th}$ of the driving transistor Td into the third node N3, and a voltage $V_{N3}$ of the third node N3 becomes the sum of the voltage $V_{data}$ of the data signal and the threshold voltage $V_{th}$ (i.e., $V_{N3}=V_{data}+V_{th}$). The data signal and the threshold voltage are transmitted by the second transistor T2 to the first terminal of the storage capacitor Cst. For example, the compensation signal is the threshold voltage $V_{th}$. Due to the coupling effect of the storage capacitor Cst, the voltage of the first node N1 changes. As a result, the voltage of the first node N1 becomes $V'_{N1}$ ($V'_{N1}=V_{data}+V_{th}+V_{init}+V_{ref}$).

In the second period t2, as shown in FIG. 10, the seventh transistor T7 is turned on, in response to a low-level voltage of the second reset signal $V_{reset2}$ received at the second reset signal terminal Re2, and transmits the initialization signal received at the initialization signal terminal Init to the light-emitting device D to initialize the light-emitting device D, so as to prevent the residual current in the light-emitting device D from affecting the display of the current frame.

In addition, in the second period t2, the fourth transistor T4 and the fifth transistor T5 are both turned off in response to the high-level voltage of the light-emitting control signal $V_{em}$ received at the light-emitting control signal terminal EM. In this case, no conductive path is formed between the first voltage terminal VDD, the driving sub-circuit 30, and the light-emitting device D. In this case, the light-emitting device D cannot emit light.

Figure 11:
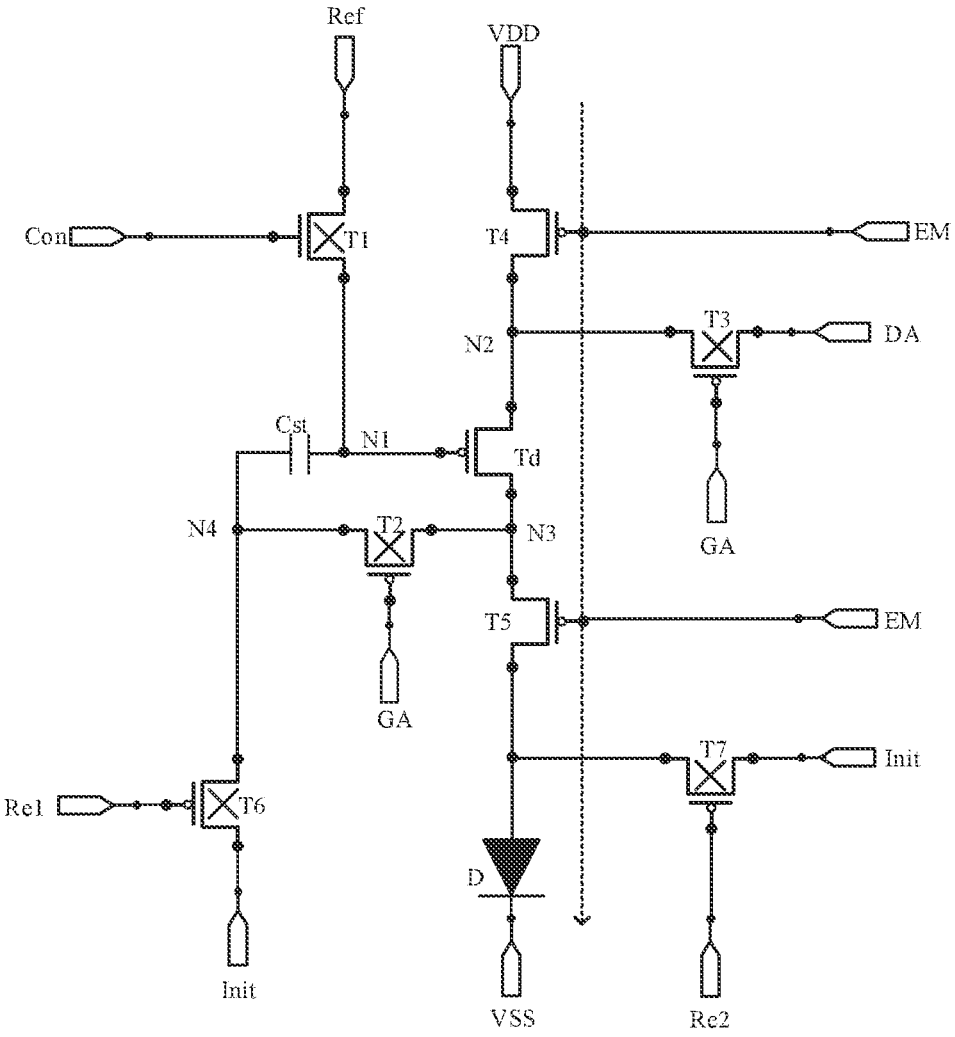

In the third period t3, as shown in FIG. 11, the fourth transistor T4 and the fifth transistor T5 are both turned on, in response to a low-level voltage of the light-emitting control signal $V_{em}$ received at the light-emitting control signal terminal EM.

In this case, the voltage $V_s$ of the source of the driving transistor Td is the first voltage $V_{dd}$, and the gate-source voltage difference $V_{gs}$ of the driving transistor Td is equal to V' ($V'=V_{data}+V_{th}+V_{init}+V_{ref}-V_{dd}$), which is less than the threshold voltage $V_{th}$. Therefore, the driving transistor Td is turned on.

The first voltage terminal VDD, the fourth transistor T4, the driving transistor Td, the fifth transistor T5, the light-emitting device D, and the second voltage terminal VSS form a conductive path, and the driving signal output by the driving transistor Td can be transmitted to the light-emitting device D, so as to drive the light-emitting device D to emit light. The driving signal Ic can be obtained by a following formula: $Ic=K\times(V_{gs}-V_{th})^2=K\times(V_{data}+V_{th}+V_{init}+V_{ref}-V_{dd}-V_{th})^2=K\times(V_{data}+V_{init}+V_{ref}-V_{dd})^2$. Here K can be obtained by a formula:

$$K=\frac{1}{2}\times\mu\times C_{OX}\times\frac{W}{L},$$

where W/L is a width-to-length ratio of driving transistor Td, $C_{OX}$ is a dielectric constant of a channel insulating layer, and μ is a channel carrier mobility. Therefore, the driving signal is not related to the threshold voltage $V_{th}$ of the driving transistor Td, thereby achieving the compensation of the threshold voltage $V_{th}$.

In some examples, the first transistor T1 is an oxide thin film transistor.

Since there is no leakage current in the storage capacitor Cst, the first transistor T1 is the main leakage path of the first node N1 (i.e., the control electrode of the driving transistor Td). On this basis, since the first transistor T1 adopts the oxide thin film transistor, and the oxide thin film transistor has a low leakage current, it may be possible to better suppress the leakage of the first node N1 (i.e., the control electrode of the driving transistor Td), and the turn-on duration of the driving transistor Td in the third period t3 may be further extended.

Each node in the embodiments of the present disclosure does not represent an actual component, but represent a junction of relevant electrical connections in the circuit diagram. That is, the node is a node equivalent to the junction of relevant electrical connections in the circuit diagram.

In some examples, for the light-emitting device D, a current-driven type device may be adopted. For example, a current-type light-emitting diode may be adopted, such as a micro light-emitting diode (Micro LED), a mini light-emitting diode (Mini LED), an organic light-emitting diode (OLED), or a quantum dot light-emitting diode (QLED).

Figure 12:
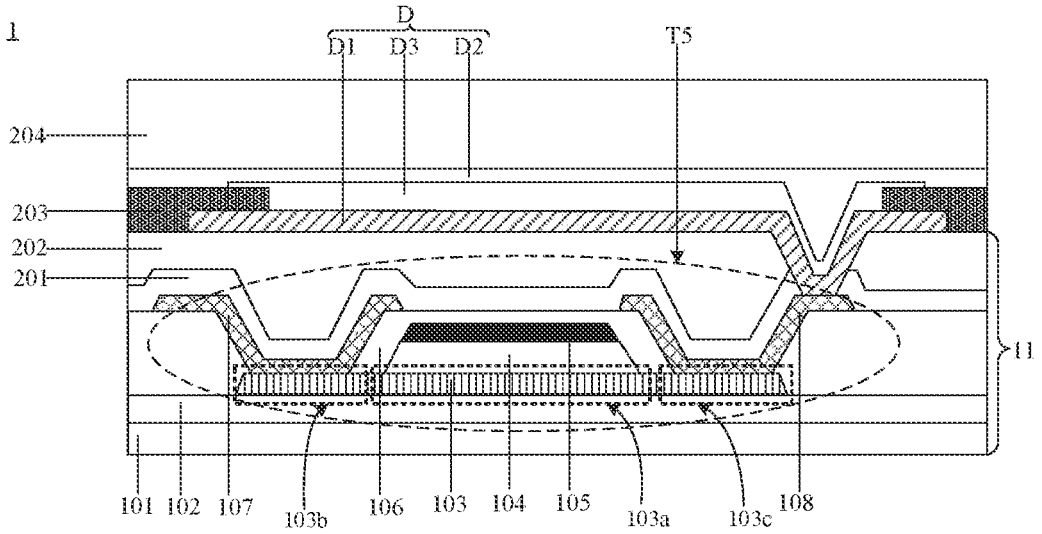
FIG. 12 is a structural diagram of another display panel, in accordance with some embodiments.

In some examples, referring to FIGS. 2 and 12, the display panel 1 includes a driving backplane 11 and light-emitting devices D arranged on the driving backplane 11. The driving backplane 11 is used for driving the light-emitting devices D to emit light.

Referring to FIGS. 2 and 12, the driving backplane 11 includes a base substrate 101 and pixel driving circuits disposed on the base substrate 101. The pixel driving circuits are the pixel driving circuits 100 as described in the above embodiments. Each pixel driving circuit includes a plurality of transistors. For example, the plurality of transistors include the first transistor T1 to the seventh transistor T7, and the driving transistor Td in FIG. 6. It will be noted that, for the convenience of description, only one transistor (e.g., the fifth transistor T5) of the plurality of transistors is shown in FIG. 10.

For example, as shown in FIG. 12, the fifth transistor T5 includes an active layer 103, a gate insulating layer 104, a gate 105, an interlayer insulating layer 106, and a source 107 and a drain 108, which are sequentially arranged on the base substrate 101. The source 107 and the drain 108 may be made of a same material and disposed in a same layer. The active layer 103 includes a channel portion 103*a*, a source portion 103*b*, and a drain portion 103*c*. The source 107 and the drain 108 are respectively coupled to the source portion 103*b* and the drain portion 103*c* of the active layer 103 through first via holes.

The driving backplane 11 further includes a buffer layer 102 disposed between the base substrate 101 and the pixel driving circuits 100. The buffer layer 102 can prevent impurities from the base substrate 101 from entering the pixel driving circuits 100, thereby protecting the stability of the layers.

In some embodiments, as shown in FIG. 12, the driving backplane 11 further includes a passivation layer 201 and a planarization layer 202, which are sequentially disposed on a side of the pixel driving circuits 100 away from the base substrate 101. The passivation layer 201 and the planarization layer 202 are provided with second via holes, each of the second via holes is used for exposing a portion of the source 107 of the fifth transistor T5 or a portion of the drain 108 of the fifth transistor T5, so that the light-emitting device D is coupled to the source 107 or the drain 108 of the fifth transistor T5 through the second via hole. FIG. 10 shows a case where the portion of the drain 108 of the thin film transistor T5 is exposed by the second via hole.

For example, the passivation layer 201 is made of an inorganic material, and the planarization layer 202 is made of an organic material.

In some examples, the base substrate 101 is a flexible base substrate, such as a polyimide (PI) substrate; or a rigid (or hard) base substrate, such as a glass substrate.

As shown in FIG. 10, the light-emitting device D includes a first electrode D1, a second electrode D2, and a light-emitting layer D3 located between the first electrode D1 and the second electrode D2. For example, the first electrode D1 is an anode, and the second electrode D2 is a cathode.

In some examples, referring to FIG. 12, the first electrode D1 of the light-emitting device D is coupled to the pixel driving circuit 100 through the second via hole penetrating through the passivation layer 201 and the planarization layer 202. For example, the first electrode D1 of the light-emitting device D is coupled to the source 107 or the drain 108 of the fifth transistor T5 in the pixel driving circuit 100 through the second via hole. In this case, the first electrode D1 of the light-emitting device D may be able to receive the driving signal from the pixel driving circuit 100, and the second electrode D2 of the light-emitting device D may be able to receive the second voltage. In this way, an electric field is formed between the first electrode D1 and the second electrode D2 of the light-emitting device D to drive the light-emitting layer D3 to emit light.

In some examples, second electrodes D2 of the plurality of light-emitting devices D may be connected to one another. For example, second electrodes D2 of the plurality of light-emitting devices may be connected to one another to form a plate-shaped electrode structure covering the display area. That is, the second electrodes D2 are of a whole-layer structure. FIG. 10 only shows a portion of the plate-shaped electrode structure, which serves as the second electrode D2 of the light-emitting device D.

In some embodiments, the display panel 1 further includes a pixel defining layer 203, which is disposed on a side of the planarization layer 202 away from the base substrate 101. The pixel defining layer 203 has a plurality of openings. The light-emitting layer D3 of one light-emitting device D is arranged in one opening.

In some examples, the light-emitting device may be of a top-emission type (i.e., the light-emitting device emits light toward a side thereof away from the driving backplane), of a bottom-emission type (i.e., the light-emitting device emits light toward a side thereof proximate to the driving backplane), or of a dual-sided-emission type (i.e., the light-emitting device emits light toward both the side thereof away from the driving backplane and the side thereof proximate to the driving backplane).

For example, for the two electrodes (i.e., the first electrode and the second electrode) of the light-emitting device, in a case where the light-emitting device is a top-emission type light-emitting device, one electrode proximate to the driving backplane (e.g. the first electrode) is opaque, and the other electrode away from the driving backplane (e.g. the second electrode) is transparent or translucent; in a case where the light-emitting device is a bottom-emission type light-emitting device, one electrode proximate to the driving backplane is transparent or translucent, and the other electrode away from the driving backplane is opaque; in a case where the light-emitting device is a double-sided-emission type light-emitting device, one electrode proximate to the driving backplane and the other electrode away from the driving backplane are both transparent or translucent.

In some embodiments, the display panel 1 further includes an encapsulation structure 204. For example, the encapsulation structure 204 may be an encapsulation film or an encapsulation substrate. In a case where the encapsulation structure 204 is an encapsulation film, the encapsulation structure 204 may be a stacked structure formed of at least three films stacked sequentially. In the stacked structure, a film most proximate to the base substrate 101 and a film farthest away from the base substrate 101 may both be inorganic films, and a film between the two adjacent inorganic films may be an organic film.

In some embodiments, the display device further includes a system motherboard, a housing, and other components.

For example, the display device described above may be any device that displays images whether in motion (e.g., videos) or stationary (e.g., static images), and whether literal or graphical. More specifically, it is anticipated that the described embodiments may be implemented in or associated with a variety of electronic devices. The variety of electronic devices may include (but are not limited to), for example, a mobile telephone, a wireless device, a personal data assistant (PDA), a hand-held or portable computer, a global positioning system (GPS) receiver/navigator, a camera, a MP4 video player, a video camera, a game console, a watch, a clock, a calculator, a TV monitor, a flat-panel display, a computer monitor, a car display (e.g., an odometer display), a navigator, a cockpit controller and/or display, a camera view display (e.g., a rear view camera display in a vehicle), an electronic photo, an electronic billboard or sign, a projector, a building structure, a packaging structure, and an aesthetic structure (e.g., a display for an image of a piece of jewelry).

The foregoing descriptions are merely specific implementations of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. A pixel driving circuit, comprising:

a reset sub-circuit coupled to a control signal terminal, a reference signal terminal and a first node, wherein the reset sub-circuit is configured to be turned on in response to a control signal received at the control signal terminal, and transmit a reference voltage received at the reference signal terminal to the first node to reset a voltage of the first node;

an input sub-circuit coupled to a gate scan signal terminal, a data signal terminal and a second node, wherein the input sub-circuit is configured to transmit a data signal received at the data signal terminal to the second node in response to a gate scan signal received at the gate scan signal terminal;

a driving sub-circuit coupled to the first node, the second node and a third node, wherein the driving sub-circuit is configured to be turned on or off in response to a voltage of the first node; and to write the data signal and a compensation signal into the third node;

a compensation sub-circuit coupled to the gate scan signal terminal, the third node and a fourth node, wherein the compensation sub-circuit is configured to transmit the data signal and the compensation signal to the fourth node in response to the gate scan signal; and a voltage control sub-circuit coupled to the first node and the fourth node, wherein the voltage control sub-circuit is configured to control the voltage of the first node according to a voltage of the fourth node, and the driving sub-circuit is further configured to output a driving signal according to the voltage of the first node, wherein the voltage control sub-circuit includes a storage capacitor, a first terminal of the storage capacitor is directly connected to the fourth node, and a second terminal of the storage capacitor is directly connected to the first node.

2. The pixel driving circuit according to claim 1, wherein the reset sub-circuit includes a first transistor;

a control electrode of the first transistor is coupled to the control signal terminal, a first electrode of the first transistor is coupled to the reference signal terminal, and a second electrode of the first transistor is coupled to the first node.

3. The pixel driving circuit according to claim 2, wherein the first transistor is an oxide thin film transistor.

4. The pixel driving circuit according to claim 1, wherein the compensation sub-circuit includes a second transistor; a control electrode of the second transistor is coupled to the gate scan signal terminal, a first electrode of the second transistor is coupled to the third node, and a second electrode of the second transistor is coupled to the fourth node.

5. The pixel driving circuit according to claim 1, wherein the input sub-circuit includes a third transistor; a control electrode of the third transistor is coupled to the gate scan signal terminal, a first electrode of the third transistor is coupled to the data signal terminal, and a second electrode of the third transistor is coupled to the second node.

6. The pixel driving circuit according to claim 1, wherein the driving sub-circuit includes a driving transistor; a control electrode of the driving transistor is coupled to the first node, a first electrode of the driving transistor is coupled to the second node, and a second electrode of the driving transistor is coupled to the third node.

7. The pixel driving circuit according to claim 1, further comprising a first light-emitting control sub-circuit coupled to a light-emitting control signal terminal, a first voltage terminal, and the second node, wherein the first light-emitting control sub-circuit is configured to transmit a first voltage of the first voltage terminal to the driving sub-circuit, in response to a light-emitting control signal received at the light-emitting control signal terminal.

8. The pixel driving circuit according to claim 7, wherein the first light-emitting control sub-circuit includes a fourth transistor; a control electrode of the fourth transistor is coupled to the light-emitting control signal terminal, a first electrode of the fourth transistor is coupled to the first voltage terminal, and a second electrode of the fourth transistor is coupled to the second node.

9. The pixel driving circuit according to claim 7, further comprising a second light-emitting control sub-circuit coupled to the light-emitting control signal terminal and the third node, wherein the second light-emitting control sub-circuit is configured to be further coupled to a light-emitting device, and is further configured to make the driving sub-circuit and the light-emitting device form a conductive path in response to the light-emitting control signal received at the light-emitting control signal terminal, so that the driving signal is transmitted to the light-emitting device.

10. The pixel driving circuit according to claim 9, wherein the second light-emitting control sub-circuit includes a fifth transistor; a control electrode of the fifth transistor is coupled to the light-emitting control signal terminal, a first electrode of the fifth transistor is coupled to the third node, and a second electrode of the fifth transistor is configured to be coupled to the light-emitting device.

11. The pixel driving circuit according to claim 9, further comprising an initialization sub-circuit coupled to a first reset signal terminal, a second reset signal terminal, an initialization signal terminal, and the fourth node, wherein the initialization sub-circuit is configured to be further coupled to the light-emitting device, and is further configured to: transmit an initialization signal received at the initialization signal terminal to the fourth node in response to a first reset signal received at the first reset signal terminal, and transmit the initialization signal to the light-emitting device in response to a second reset signal received at the second reset signal terminal.

12. The pixel driving circuit according to claim 11, wherein the initialization sub-circuit includes a sixth transistor and a seventh transistor;

a control electrode of the sixth transistor is coupled to the first reset signal terminal, a first electrode of the sixth transistor is coupled to the initialization signal terminal, and a second electrode of the sixth transistor is coupled the fourth node; and a control electrode of the seventh transistor is coupled to the second reset signal terminal, a first electrode of the seventh transistor is coupled to the initialization signal terminal, and a second electrode of the seventh transistor is configured to be coupled to the light-emitting device.

13. The pixel driving circuit according to claim 1, further comprising an initialization sub-circuit coupled to a first reset signal terminal, a second reset signal terminal, an initialization signal terminal, the third node and the fourth node, and the third node being further electrically connected to a light-emitting device, wherein the initialization sub-circuit is configured to: transmit an initialization signal received at the initialization signal terminal to the fourth node in response to a first reset signal received at the first reset signal terminal, and transmit the initialization signal to the light-emitting device in response to a second reset signal received at the second reset signal terminal.

14. The pixel driving circuit according to claim 13, wherein the initialization sub-circuit includes a sixth transistor and a seventh transistor;

a control electrode of the sixth transistor is coupled to the first reset signal terminal, a first electrode of the sixth transistor is coupled to the initialization signal terminal, and a second electrode of the sixth transistor is coupled the fourth node; and a control electrode of the seventh transistor is coupled to the second reset signal terminal, a first electrode of the seventh transistor is coupled to the initialization signal terminal, and a second electrode of the seventh transistor is coupled to the third node.

15. The pixel driving circuit according to claim 1, further comprising: a first light-emitting control sub-circuit, a second light-emitting control sub-circuit, and an initialization sub-circuit, wherein the reset sub-circuit includes a first transistor; the input sub-circuit includes a third transistor; the driving sub-circuit includes a driving transistor; the compensation sub-circuit includes a second transistor; the first light-emitting control sub-circuit includes a fourth transistor; the second light-emitting control sub-circuit includes a fifth transistor; and the initialization sub-circuit includes a sixth transistor and a seventh transistor;

a control electrode of the driving transistor is coupled to the first node, a first electrode of the driving transistor is coupled to the second node, and a second electrode of the driving transistor is coupled to the third node;

a control electrode of the first transistor is coupled to the control signal terminal, a first electrode of the first transistor is coupled to the reference signal terminal, and a second electrode of the first transistor is coupled to the first node;

a control electrode of the third transistor is coupled to the gate scan signal terminal, a first electrode of the third transistor is coupled to the data signal terminal, and a second electrode of the third transistor is coupled to the second node;

a control electrode of the second transistor is coupled to the gate scan signal terminal, a first electrode of the second transistor is coupled to the third node, and a second electrode of the second transistor is coupled to the fourth node;

a control electrode of the fourth transistor is coupled to a light-emitting control signal terminal configured to provide a light-emitting control signal, a first electrode of the fourth transistor is coupled to a first voltage terminal configured to provide a first voltage, and a second electrode of the fourth transistor is coupled to the second node;

a control electrode of the fifth transistor is coupled to the light-emitting control signal terminal, a first electrode of the fifth transistor is coupled to the third node, and a second electrode of the fifth transistor is configured to be coupled to a light-emitting device;

a control electrode of the sixth transistor is coupled to a first reset signal terminal configured to provide a first reset signal, a first electrode of the sixth transistor is coupled to an initialization signal terminal configured to provide an initialization signal, and a second electrode of the sixth transistor is coupled to the fourth node; and a control electrode of the seventh transistor is coupled to a second reset signal terminal configured to provide a second reset signal, a first electrode of the seventh transistor is coupled to the initialization signal terminal, and a second electrode of the seventh transistor is configured to be coupled to the light-emitting device.

16. The pixel driving circuit according to claim 15, wherein an on-off type of the first transistor is opposite to an on-off type of the second transistor, the third transistor, the fourth transistor, the fifth transistor, the sixth transistor, the seventh transistor, and the driving transistor.

17. A display device, comprising:

a plurality of pixel driving circuits each of which is according to the pixel driving circuit of claim 1; and a plurality of light-emitting devices, wherein the pixel driving circuit is coupled to a light-emitting device of the plurality of light-emitting devices, and the light-emitting device is further coupled to a second voltage terminal configured to provide a second voltage.

18. A driving method of the pixel driving circuit according to claim 1, the driving method comprising:

transmitting, by the reset sub-circuit, the reference voltage received at the reference signal terminal to the first node, in response to the control signal received at the control signal terminal;

transmitting, by the input sub-circuit, the data signal received at the data signal terminal to the second node, in response to the gate scan signal received at the gate scan signal terminal;

writing, by the driving sub-circuit, the data signal and the compensation signal into the third node;

transmitting, by the compensation sub-circuit, the data signal and the compensation signal to the fourth node, in response to the gate scan signal;

controlling, by the storage capacitor, the voltage of the first node according to the voltage of the fourth node; and outputting, by the driving sub-circuit, the driving signal according to the voltage of the first node.

19. The driving method according to claim 18, wherein the pixel driving circuit further includes: an initialization sub-circuit, a first light-emitting control sub-circuit, and a second light-emitting control sub-circuit; the first light-emitting control sub-circuit is coupled to a light-emitting control signal terminal, a first voltage terminal and the second node; the second light-emitting control sub-circuit is coupled to the light-emitting control signal terminal and the third node, and is configured to be coupled to a light-emitting device; the initialization sub-circuit is coupled to a first reset signal terminal, a second reset signal terminal, an initialization signal terminal and the fourth node, and is configured to be coupled to the light-emitting device; and the driving method further comprises:

transmitting, by the initialization sub-circuit, an initialization signal received at the initialization signal terminal to the fourth node, in response to a first reset signal received at the first reset signal terminal;

transmitting, by the initialization sub-circuit, the initialization signal to the light-emitting device, in response to a second reset signal received at the second reset signal terminal;

transmitting, by the first light-emitting control sub-circuit, a first voltage of the first voltage terminal to the driving sub-circuit, in response to a light-emitting control signal received at the light-emitting control signal terminal; and transmitting, by the second light-emitting control sub-circuit, the driving signal output by the driving sub-circuit according to the voltage of the first node and the first voltage to the light-emitting device, in response to the light-emitting control signal received at the light-emitting control signal terminal.

20. The driving method according to claim 19, wherein the driving sub-circuit includes a driving transistor; and an absolute value of a difference between the reference voltage and the first voltage is greater than an absolute value of a threshold voltage of the driving transistor.

* * * * *